US008227157B2

(12) United States Patent
Toriyama et al.

(10) Patent No.: US 8,227,157 B2
(45) Date of Patent: Jul. 24, 2012

(54) SINGLE-LAYER ELECTROPHOTOGRAPHIC PHOTORECEPTOR AND IMAGE FORMING APPARATUS PROVIDED WITH THE SAME

(75) Inventors: Koichi Toriyama, Osaka (JP); Mami Adachi, Osaka (JP)

(73) Assignee: Sharp Kabushiki Kaisha, Osaka-shi, Osaka (JP)

( * ) Notice: Subject to any disclaimer, the term of this patent is extended or adjusted under 35 U.S.C. 154(b) by 544 days.

(21) Appl. No.: 12/486,049

(22) Filed: Jun. 17, 2009

(65) Prior Publication Data

US 2010/0014889 A1 Jan. 21, 2010

(30) Foreign Application Priority Data

Jun. 18, 2008 (JP) ..... 2008-159234

(51) Int. Cl.
*G03G 15/00* (2006.01)

(52) U.S. Cl. ..... 430/72; 430/56; 430/58.05; 430/58.85; 430/69; 430/70; 430/71; 430/73; 430/74; 430/75; 430/76

(58) Field of Classification Search ..... 430/56, 430/69, 58.05, 58.85, 70–76
See application file for complete search history.

(56) References Cited

U.S. PATENT DOCUMENTS

| | | | | |
|---|---|---|---|---|
| 3,484,237 | A | 12/1969 | Shattuck et al. | |
| 5,736,285 | A * | 4/1998 | Nukada et al. | 430/83 |
| 7,468,231 | B2 * | 12/2008 | Lin et al. | 430/75 |
| 2006/0292468 | A1 * | 12/2006 | Yokota et al. | 430/58.65 |
| 2007/0026334 | A1 * | 2/2007 | Morita et al. | 430/72 |

FOREIGN PATENT DOCUMENTS

| | | |
|---|---|---|
| JP | 9-240051 | 9/1997 |
| JP | 2718048 | 11/1997 |
| JP | 2000-47408 | 2/2000 |

* cited by examiner

*Primary Examiner* — Mark F Huff
*Assistant Examiner* — Stewart Fraser
(74) *Attorney, Agent, or Firm* — Nixon & Vanderhye, PC

(57) ABSTRACT

The present invention provides a single-layer electrophotographic photoreceptor provided with a single-layer photosensitive layer that adapts to an exposing source emitting a laser beam with wavelengths of from 400 nm to 450 nm inclusive and is laminated on a conductive substrate, the single-layer photosensitive layer comprising: an enamine-type compound that functions as both a charge generation material and a charge transport material and is represented by the following general formula (1); and a perylene-type compound that functions as both an electron-transport material and a sensitizer and is represented by the following general formula (2):

(1)

and (2)

8 Claims, 3 Drawing Sheets

SINGLE-LAYER ELECTROPHOTOGRAPHIC PHOTORECEPTOR AND IMAGE FORMING APPARATUS PROVIDED WITH THE SAME

CROSS-REFERENCE TO RELATED APPLICATION

This application is related to Japanese Patent Application No. 2008-159234 filed on 18 Jun. 2008, whose priority is claimed and the disclosure of which is incorporated by reference in its entirety.

BACKGROUND OF THE INVENTION

1. Field of the Invention

The present invention relates to an electrophotographic photoreceptor used for forming an image on an electrophotographic principle, and an image forming apparatus provided with the electrophotographic photoreceptor.

2. Description of the Related Art

An image forming apparatus (hereinafter also referred to as "electrophotographic device") on an electrophotographic principle that forms an image with use of an electrophotographic technology is diversely used as a copy machine, a printer, a facsimile machine, or the like.

The electrophotographic device is generally provided with an electrophotographic photoreceptor (hereinafter also referred to as "Photoreceptor"), an electrostatic charger, exposure means, image development means, transfer means, and fixing means.

The above-mentioned photoreceptor is generally constituted of: a conductive substrate comprising a conducting material; and a photosensitive layer comprising a photoconductive material laminated on the conductive substrate.

Examples of the above-mentioned photoreceptor include: an inorganic photoreceptor such as a selenium-based photoreceptor in which a photosensitive layer comprises amorphous selenium (a-Se) or amorphous arsenic selenium (a-AsSe), a zinc oxide-based photoreceptor in which a photosensitive layer comprises zinc oxide (ZnO), a cadmium sulfide-based photoreceptor in which a photosensitive layer comprises cadmium sulfide (CdS), an amorphous silicon-based photoreceptor in which a photosensitive layer comprises amorphous silicon (a-Si), and the like; and an organic photoreceptor in which a photosensitive layer comprises an organic photoconductive material, that is, an organic photoconductor (abbreviation: OPC).

The organic photoreceptor has slight problems concerning sensitivity, durability, stability to environments, and the like, but has many advantages, in comparison with the inorganic photoreceptor, in point of toxicity, manufacturing cost, freedom of material designing, and the like.

Also, the organic photoreceptor has a characteristic that a photosensitive layer can be formed by an easy and inexpensive method as represented by, for example, a dip coating method, and therefore it has been becoming mainstream of photoreceptors at present.

As a structure of such an organic photoreceptor, a variety of structures are proposed which include: a single-layer structure comprising both a charge generation material and a charge transport material (also referred to as "charge transfer material") dispersed in a binding resin (also referred to as "binder resin" or "binding agent resin"), which is positioned on the conductive substrate comprising the conducting material; a laminated structure in which a charge generation layer comprising a charge generation material dispersed in a binding resin and a charge transport layer comprising a charge transport material dispersed in a binding resin are laminated on the conductive substrate in this order; a reverse-laminated structure in which the above-mentioned layers are laminated on the conductive substrate in a reverse order; and the like.

The organic photoreceptor having the laminated structure in which the charge transport layer is laminated on the charge generation layer is a functional separation type, and is excellent in electrophotographic property and durability. Also, the organic photoreceptor having the laminated structure can diversely utilize a photoreceptor property due to high freedom of material designing, and therefore it has been practically used extensively.

Although a laser printer is a typical example of the electrophotographic device in which a laser is an exposing source, a copy machine has been digitalized in recent years and thereby has commonly used a laser as an exposing source as well.

Among lasers used as an exposing source, a semiconductor laser has practically been used due to low cost, low energy consumption, lightweight, and compact size. Particularly, a semiconductor laser has commonly been used, having stability of an oscillation wavelength and an output, and a long lifetime due to the oscillation wavelength of around 800 nm in a near-infrared area.

A reason why such a semiconductor laser has commonly been used is that there was technical difficulty to practically use a laser which oscillates a laser beam with a wavelength shorter than the above-mentioned wavelength.

Therefore, as a charge generation material used in the electrophotographic device in which the semiconductor laser is the exposing source, an organic compound having sensitivity that light is absorbed in a long-wavelength area has generally been developed, and a laminated photoreceptor having a charge generation layer comprising the organic compound, particularly a phthalocyanine pigment, has been developed.

In the meanwhile, a manufacturing method of a blue light emitting diode (disclosed in Japanese Patent No. 2628404) was invented in 1990, and technologies related to a blue light semiconductor laser have vigorously been developed since then. Consequently, a next-generation disc, which is designated as a blue-ray disc that uses the technology of this blue light semiconductor laser, has quickly been widespread.

Also, heightening resolution of an image has been studied in recent years in order to improve quality of the image outputted from an electrophotographic device.

As a means of achieving the high resolution, i.e. a high record density, of the image, an optical method is exemplified, which is to narrow a spot diameter of a laser beam and to increase the record density.

On this account, a focal length of a lens used for narrowing the spot diameter of the laser beam needs to be shortened. However, design difficulty in terms of an optical system arises, and additionally it is difficulty to obtain clearness of a spot outline of the laser beam that has the oscillation wavelength of around 800 nm in the near-infrared area even if the spot diameter of the laser beam is narrowed by controlling the optical system. A reason why the clearness of the spot outline is difficult to be obtained is that diffraction of the laser beam is limited, and it is an inevitable phenomenon.

A spot diameter of a laser beam which is focused onto a peripheral surface of a photoreceptor can generally be calculated from an oscillation wavelength of the laser beam and a lens numerical aperture, and is represented by the following formula:

$$D=1.22\lambda/NA$$

wherein D represents the spot diameter, λ represents the oscillation wavelength of the laser beam, and NA represents the lens numerical aperture.

According to the above-mentioned formula, it is recognized that the spot diameter D is proportional to the oscillation wavelength of the laser beam. Therefore, a shorter spot diameter can be obtained by shortening an oscillation wavelength.

Accordingly, it is understood that the blue light semiconductor laser, instead of a near-infrared semiconductor laser which is mainly used at present, can actualize higher resolution of an image.

As a means of obtaining the high resolution of an image, a single-layer photoreceptor, instead of the laminated photoreceptor which is mainly used at present, can be used.

The laminated photoreceptor is generally constituted of the charge transport layer arranged on the surface side and the charge generation layer arranged on the substrate side. This arrangement is for the purpose of protecting the charge generation layer that is weak in film strength with the charge transport layer that has strong film strength due to a resinous component which is highly contained in the charge transport layer.

In the above-mentioned arrangement, a laser beam passes through the charge transport layer on the surface side and reaches to the charge generation layer, and then electrical charges are generated in the charge generation layer. Due to an electric field, one electrical charge flows toward the substrate side, and another electrical charge flows toward the surface side, and then an electrical charge on a peripheral surface of the laminated photoreceptor is eliminated. In such a case, some of the electrical charge in the charge transport layer are scattered about, and by the time these electrical charges reach to the photoreceptor surface, an electrical latent image is unclear. Unclearness of the electrical latent image increases with a thickness of the charge transport layer.

The single-layer photoreceptor, on the other hand, generates electrical charges in the vicinity of a peripheral surface thereof, and the electrical charges are not scattered about, and therefore an electrical latent image is clearly developed.

Laminated organic photoreceptors can be grouped into a negative electric type in which a charge transport material, which is a major functional component, is an electron-hole-transport material, and into a positive electric type in which a charge transport material is an electron-transport material.

With research and development of the organic photoreceptors, the electron-hole-transport material which has an excellent charge-transport function has swiftly been developed, and therefore the negative electric-type photoreceptor has practically been used. However, the negative electric-type photoreceptor has problems such that it generates harmful ozone and nitrogen oxides in large quantities, electrification cannot be uniformly made by a corona discharge, and the like.

On the other hand, the positive electric-type photoreceptor does not have the problems that the negative electric-type photoreceptor has. Also, the positive electric-type photoreceptor can adopt a process technology for a positive electric-type inorganic photoreceptor, such as a selenium-based photoreceptor and an amorphous silicon (a-Si) photoreceptor, and therefore a highly functional positive electric-type organic photoreceptor has strongly been desired. Japanese Patent No. 2718048 discloses a photoreceptor in which a diphenoquinone compound is used as a charge transport material having an electron-transport function, but the photoreceptor does not have adequate sensitivity since the diphenoquinone compound has a slow charge-transfer rate.

Hitherto developed positive electric-type organic photoreceptors include: a single-layer photoreceptor of U.S. Pat. No. 3,484,237 that is provided with a charge-transfer complex comprising polyvinyl carbazole (PVCz) and trinitrofluorenone (TNF); and a single-layer photoreceptor in which a charge generation material and an electron-hole-transport material are dispersed in a binding agent. The both photoreceptors are no longer used, since the former photoreceptor has low sensitivity, and TNF used therein is a carcinogenic material, and the latter photoreceptor has low sensitivity and charge retentivity, and an electric property which decreases after the photoreceptor is repeatedly used.

Japanese Unexamined Patent Application Publication No. HEI 9(1997)-240051 discloses a single-layer photoreceptor that adapts to a blue light semiconductor laser and comprises an α-type oxytitanium phthalocyanine pigment as a charge generation material.

Japanese Unexamined Patent Application Publication No. 2000-47408 discloses a single-layer photoreceptor that adapts to a blue light semiconductor laser and comprises a perylene-type compound as a charge generation material, but only discloses functions of a laminated photoreceptor. In the case where the charge generation material is the perylene-type compound, the photoreceptor cannot have adequate sensitivity in a short-wavelength area.

The single-layer photoreceptor disclosed in Japanese Unexamined Patent Application Publication No. HEI 9(1997)-240051 adapts to the blue light semiconductor laser as an exposing source, requires the charge generation material as an essential component, which is also required in conventional image forming apparatuses, and comprises the α-type oxytitanium phthalocyanine pigment, a dye, and the like as organic pigments.

Generally, a single-layer photoreceptor comprises in its entire peripheral surface layer both a charge generation material, which is a low-molecular compound, and a charge transport material. The single-layer photoreceptor therefore has a problem that wear resistance of the peripheral surface layer is weak, in comparison with wear resistance of a laminated photoreceptor that comprises only a charge transport material on the surface side.

Japanese Unexamined Patent Application Publication No. 2000-47408 discloses the single-layer photoreceptor comprising a styryl-type compound as an electron-hole-transport material, an electron transport material, and a phthalocyanine pigment as the charge generation material.

The single-layer photoreceptor of Japanese Unexamined Patent Application Publication No. 2000-47408 has problems that sensitivity is low in a short-wavelength area, wear resistance is weak, and the pigment itself, which generates electrical charges, functions as a trap during charge transport and thereby induces the low sensitivity and an increase of a residual potential after the photoreceptor is repeatedly used.

The present invention has an object of providing a single-layer photoreceptor and an electrophotographic device provided therewith, the single-layer photoreceptor having a high sensitivity behavior even in a long-wavelength area of a blue light semiconductor laser with exposure wavelengths of from 400 nm to 450 nm inclusive, being excellent in electric property and mechanical durability, and having high durability so as not to generate an abnormal image.

SUMMARY OF THE INVENTION

After carrying out patient and effortful research, the inventors of the present invention have found that a highly sensitive single-layer photoreceptor, which is suitable for being exposed by a blue light semiconductor laser, and an electrophotographic device provided with the single-layer photoreceptor can be provided, the single-layer photoreceptor comprising: an enamine-type compound, which has a specific substituent(s) disclosed in Japanese Unexamined Patent Application Publication No. 2000-47408, and has originally been known as a high-mobility charge transport material but functions as a charge generation material (see FIG. 4) due to an absorption band adapting to a wavelength area of the blue light semiconductor laser, unlike other charge transport materials; and a perylene-type compound as both an electron-transport material and a sensitizer.

Namely, the inventors have found that the single-layer electrophotographic photoreceptor, which does not require an organic pigment but comprises the enamine type compound as both the charge generation material and the charge transport material and the perylene-type compound as both the electron-transport material and the sensitizer, is suitable for being exposed by the blue light semiconductor laser since it has remarkably high spectral sensitivity, high sensitivity and electrification, and is capable of outputting an image with high resolution.

Accordingly, the present invention provides a single-layer electrophotographic photoreceptor provided with a single-layer photosensitive layer that adapts to an exposing source emitting a laser beam with wavelengths of from 400 nm to 450 nm inclusive and is laminated on a conductive substrate, the single-layer photosensitive layer comprising; an enamine-type compound that functions as both a charge generation material and a charge transport material and is represented by the general formula (1):

(1)

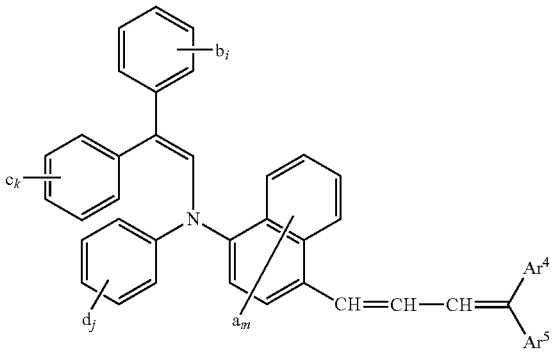

wherein a represents a hydrogen atom, a halogen atom or an alkyl, alkoxy, dialkylamino or aryl group, which may have a substituent(s);

m represents an integer of 1 to 6, and when m represents the integer of 2 or more, a is plural and may be the same or different, and when a represents the alkyl group, the adjacent a may bind to each other and form a ring structure;

b, c and d may be the same or different, and each represent a hydrogen atom, a halogen atom or an alkyl, alkoxy, dialkylamino, aryl, aryloxy or arylthio group, which may have a substituent(s);

i, j and k may be the same or different, and each represent an integer of 1 to 5, and when i, j or k represents the integer of 2 or more, b, c or d is plural and may be the same or different, and b, c or d which binds to adjacent carbon atoms of a benzene ring may bind to each other and form a ring structure; and $Ar^4$ and $Ar^5$ may be the same or different, and each represent a hydrogen atom, an alkyl group or an aryl, aralkyl or heterocyclic group, which may have a substituent(s), but may not simultaneously be the hydrogen atoms, and may bind to each other by means of an atom or an atom group and form a ring structure; and a perylene-type compound that functions as both an electron-transport material and a sensitizer and is represented by the general formula (2):

(2)

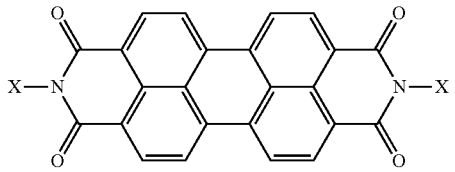

wherein X represents a hydrogen atom or alkyl, alkoxy or aryl group which may be substituted.

The present invention also provides an image forming apparatus (also referred to as an electrophotographic device) that is provided with: the above-mentioned single-layer photoreceptor; charging means that charges the single-layer photoreceptor; exposure means that exposes the charged single-layer photoreceptor to a laser beam with exposure wavelengths of from 400 nm to 450 nm inclusive; and image development means that develops an electrical latent image formed by the exposure.

The present invention further provides a single-layer electrophotographic photoreceptor (also referred to as a single-layer photoreceptor) and an electrophotographic device provided therewith, the single-layer electrophotographic photoreceptor being suitable for being exposed by a blue light semiconductor laser, having high sensitivity and resolution, and being stable. Furthermore, the single-layer photoreceptor of the present invention is suitable for a positive electric type that generates less ozone.

Electrical charges excited by a laser beam in a laminated photoreceptor are injected from a charge generation layer to a charge transport layer, and electrical charges in a single-layer photoreceptor are injected from a charge generation material to a charge transport material. This efficiency is called an injection efficiency. Normally, there is a potential barrier between the layers in the case of the laminated photoreceptor and between the materials in the case of the single-layer photoreceptor, and this potential barrier becomes one of causes of low sensitivity of the photoreceptor. The enamine-type compound of the present invention, however, functions as both the charge generation material and the charge transport material, and therefore does not have such a problem.

DESCRIPTION OF THE PREFERRED EMBODIMENTS

A single-layer photoreceptor of the present invention is formed from a single-layer photosensitive layer positioned on a conductive substrate comprising a conducting material, the single-layer photosensitive layer comprising: an enamine-type compound that is represented by the above-mentioned general formula (1) and functions as both a charge generation material and a charge transport material; and a perylene-type compound that is represented by the above-mentioned general formula (2) and functions as both an electron-transport material and a sensitizer.

Incidentally, the phrase "electrical charges" used in the present invention indicates electron holes.

The single-layer photoreceptor of the present invention will be described in detail with reference to the drawings.

Figure 1:
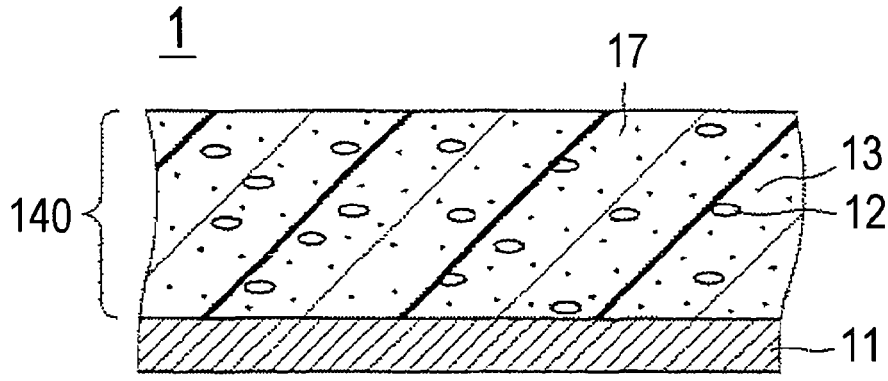
FIG. 1 is a typical cross-section view showing an essential structure of a single-layer photoreceptor of the present invention.
Figure 2:
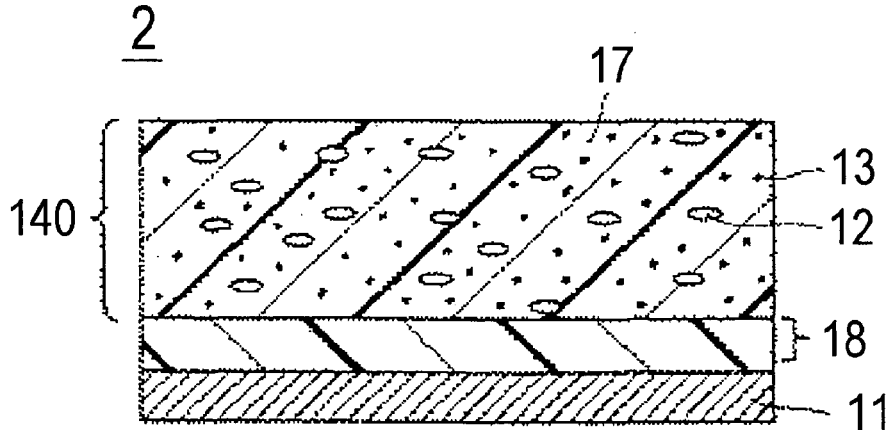
FIG. 2 is a typical cross-section view showing an essential structure of a single-layer photoreceptor of the present invention.

FIGS. 1 and 2 each are the typical cross-section view showing the essential structure of the single-layer photoreceptor of the present invention.

A single-layer photoreceptor 1 shown in FIG. 1 is formed from a single-layer photosensitive layer 140 positioned on a conductive substrate 11, the single-layer photosensitive layer 140 comprising an enamine-type compound 12 and a perylene-type compound 13.

A single-layer photoreceptor 2 shown in FIG. 2 is formed from a single-layer photosensitive layer 140 that is positioned on an intermediate layer 18 positioned on a conductive substrate 11, the single-layer photosensitive layer 140 comprising an enamine-type compound 12 and a perylene-type compound 13.

Incidentally, the reference numeral 17 denotes a binder resin.

Conductive Substrate 11

A constituent material of the conductive substrate is not particularly limited, as long as it functions as an electrode and a supporting member of the single-layer photosensitive layer 140, and any material used in a relevant field can be used as the constituent material.

In particular, examples of the constituent material of the conductive substrate include: a metallic material such as aluminum, aluminum alloy, copper, zinc, stainless steel, titanium, and the like; a high-polymer material such as polyethylene terephthalate, polyamide, polyester, polyoxymethylene, polystyrene, and the like; a substrate made of hard paper, glass, or the like laminated with a metallic foil on its surface; a substrate vapor-deposited with the metallic material; a substrate vapor-deposited or coated with a conductive compound such as a conductive polymer, tin oxide, indium oxide, and the like.

Figure 3:
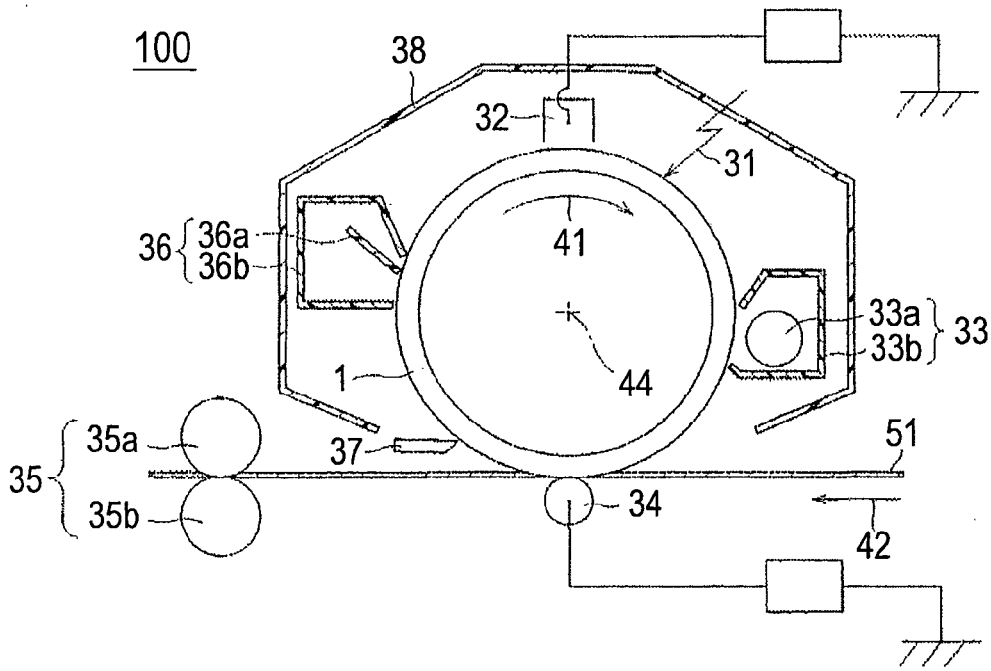
FIG. 3 is a typical side view showing a structure of an electrophotographic device of the present invention.
Figure 4:
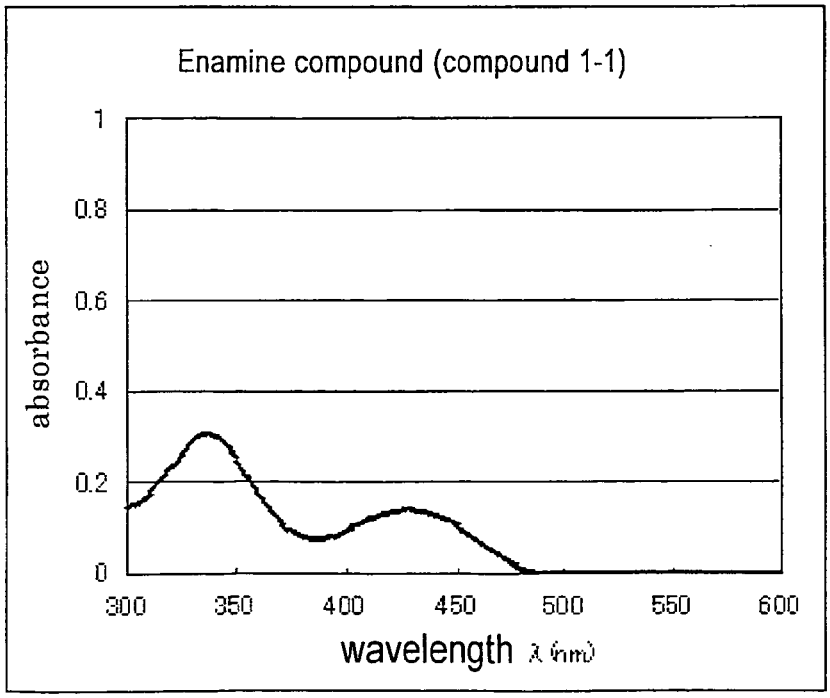
FIG. 4 shows absorption spectra of an enamine-type compound of the present invention (in which an enamine-type compound concentration of 0.01% is dissolved in tetrahydrofu.ran (THF), and the absorption spectra are measured by a spectrophotometer (manufactured by Hitachi, Ltd.))

A form of the conductive substrate is not limited to a sheet-like substrate as shown in FIGS. 1 and 2 and a cylindrical substrate as shown in FIG. 3 to be hereinafter described, and may be a columnar or belt-like substrate or the like.

A surface of the conductive substrate 11 may be subjected to, as needed and within the bounds of not affecting image quality, an alumite treatment; a surface treatment by use of a chemical, hot water, or the like; a staining treatment; or a diffuse treatment which roughens the conductive substrate surface.

The above-mentioned diffuse treatment is particularly effective for the single-layer photoreceptor of the present invention in an electrophotographic process which uses a laser as an exposing source. In the electrophotographic process which uses the laser as the exposing source, wavelengths of a laser beam are usually uniform, and therefore a laser beam reflected off a peripheral surface of the single-layer photoreceptor and a laser beam reflected off the inside of the single-layer photoreceptor interfere with each other, and this interference could cause an image defect due to an interference pattern appeared on an image. This image defect caused by the uniform wavelengths of the laser beam can be prevented by the diffuse treatment to which the conductive substrate surface is subjected.

Single-Layer Photosensitive Layer 140

The single-layer photosensitive layer comprises: the enamine-type compound which is represented by the above-mentioned general formula (1) and functions as both the charge generation material and the charge transport material; and the binder resin.

A charge generation material is essentially capable of generating electrical charges by absorbing light.

The image forming apparatus of the present invention uses a blue light semiconductor laser comprising a gallium nitride-based material with exposure wavelengths of from 400 nm to 450 nm inclusive, and the enamine-type compound of the present invention represented by the above-mentioned general formula (1) is capable of absorbing a laser beam emitted from the blue light semiconductor laser, generating electrical charges, and even transporting the electrical charges.

Organic pigments which have conventionally been used as a charge generation material in a relevant field, for example, an azo-based pigment (such as monoazo-based pigment, bisazo-based pigment, trisazo based pigment, and the like), an indigo-based pigment (such as indigo, thioindigo, and the like), a polycyclic quinone-based pigment (such as anthraquinone, pyrenequinone, and the like), a squarylium dye, pyrylium salts, thiopyrylium salts, a triphenylmethane-based dye, and the like, are not capable of absorbing light in this wavelength area, and therefore are not capable of generating electrical charges.

If these organic pigments are used, they could function as a trap site of the electrical charges and cause low sensitivity. Therefore, these organic pigments are not preferable to be used.

As both the charge generation material and the charge transport material, the single-layer photosensitive layer of the present invention comprises the enamine-type compound represented by the following general formula (1):

(1)

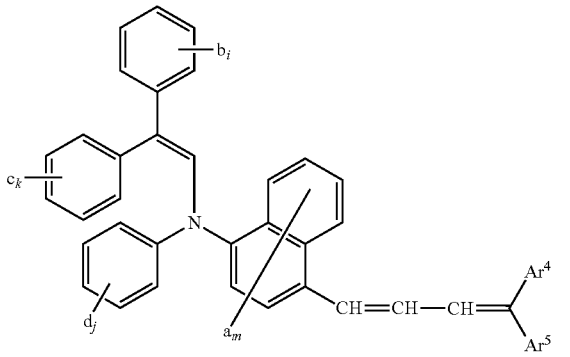

wherein a represents a hydrogen atom, a halogen atom or alkyl, alkoxy, dialkylamino or aryl group, which may have a substituent(s);

m represents an integer of 1 to 6, and when m represents the integer of 2 or more, a is plural and may be the same or different, and when a represents the alkyl group, the adjacent a may bind to each other and form a ring structure;

b, c and d may be the same or different, and each represent a hydrogen atom, a halogen atom or an alkyl, alkoxy, a dialkylamino, aryl, aryloxy or arylthio group, which may have a substituent(s);

i, j and k may be the same or different, and each represent an integer of 1 to 5, and when i, j or k represents the integer of 2 or more, b, c or d is plural and may be the same or different, and b, c or d which binds to adjacent carbon atoms of a benzene ring may bind to each other and form a ring structure; and $Ar^4$ and $Ar^5$ may be the same or different, and each represent a hydrogen atom or an alkyl, aryl, aralkyl or heterocyclic group, which may have a substituent(s), buy may not simultaneously be the hydrogen atoms, and may bind to each other by means of an atom or an atom group and form a ring structure.

The substituent(s) contained in the above-mentioned general formula, (1) will be described in detail below.

Examples of the halogen atom represented by a in the general formula (1) include a fluorine atom, chlorine atom, bromine atom and iodine atom. Among these examples, the fluorine atom is preferable.

Examples of the alkyl group represented by a, which may have the substituent(s), include an alkyl group having from 1 to 4 carbon atoms inclusive.

In particular, methyl group, ethyl group, n-propyl group, isopropyl group, n-butyl group, isobutyl group, methoxyethyl group, fluoromethyl group, trifluoromethyl group, and the like are exemplified. Among these groups, the methyl group, the isopropyl group, and the trifluoromethyl group are preferable.

The alkoxy group represented by a, which may have the substituent(s), includes alkoxy group having from 1 to 4 carbon atoms inclusive, In particular, methoxy group, ethoxy group, n-propoxy group, isopropoxy group, n-butoxy group, isobutoxy group, and the like are exemplified. Among these groups, the methoxy group is preferable.

An alkyl group of the dialkylamino group represented by a, which may have the substituent(s), includes alkyl group having from 1 to 4 carbon atoms inclusive.

In particular, dimethylamino group, diethylamino group, diisopropylamino group, and the like are exemplified.

The aryl group represented by a, which may have the substituent(s), includes aryl group which may have an alkyl group or alkoxy group both having from 1 to 4 carbon atoms inclusive.

In particular, phenyl group, tolyl group, xylyl group, methoxyphenyl group, methylmethoxyphenyl group, 4-chlorophenyl group, 4-fluorophenyl group, naphthyl group, methoxynaphthyl group, and the like are exemplified.

The halogen atom, the alkyl group, the alkoxy group or the dialkylamino group, which may have the substituent(s), represented by b, c and d includes the above-listed atoms and groups represented by a.

The aryl group represented by b, c and d, which may have the substituent(s), includes aryl group having from 6 to 12 carbon atoms inclusive, which may have alkyl group or alkoxy group, having from 1 to 4 carbon atoms inclusive.

In particular, phenyl group, tolyl group, xylyl group, methoxyphenyl group, methylmethoxyphenyl group, 4-chlorophenyl group, 4-fluorophenyl group, biphenylyl group, naphthyl group, methoxynaphthyl group, and the like are exemplified. Among these groups, the phenyl group and the biphenylyl group are preferable.

Examples of the aryloxy group and the arylthio group represented by b, c and d, which may have the substituent(s), include 4-methylphenoxy group, phenylthio group, and the like.

The alkyl group represented by $Ar^4$ and $Ar^5$, which may have the substituent(s), includes the above-listed atoms and groups represented by a, and the methyl group is preferable.

Examples of the aryl group represented by $Ar^4$ and $Ar^5$, which may have the substituent(s), include halogen atom and aryl group which may be substituted with alkyl group or alkoxy group having from 1 to 4 carbon atoms inclusive or dialkylamino group having from 2 to 6 carbon atoms inclusive.

In particular, the above-listed atoms and groups represented by a are exemplified as the halogen atom. As the aryl group, phenyl group, tolyl group, xylyl group, isopropylphenyl group, methoxyphenyl group, methylmethoxyphenyl group, t-butylphenyl group, 4-diethylaminophenyl group, 4-chlorophenyl group, 2-fluorophenyl group, 4-fluoroethylphenyl group, naphthyl group, methoxynaphthyl group, and the like are exemplified. Among these groups, the phenyl group, the tolyl group, the methoxyphenyl group, and the naphthyl group are preferable.

The aralkyl group represented by $Ar^4$ and $Ar^5$, which may have the substituent(s), includes benzyl group and the like.

Examples of the heterocyclic group represented by $Ar^4$ and $Ar^5$, which may have the substituent(s), include chromanyl group, thienyl group, 5-methythienyl group, furyl group, and the like.

In particular, the above-mentioned general formula (1) has the following partial structure:

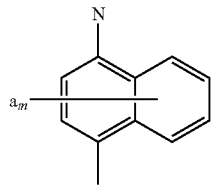

which may be as follows;

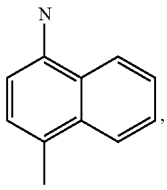

,

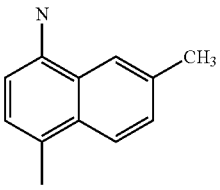

,

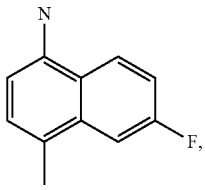

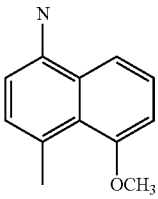

or

-continued
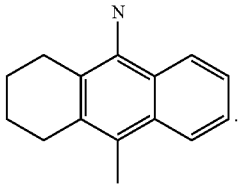
The above mentioned general formula (1) also has the following partial structures:
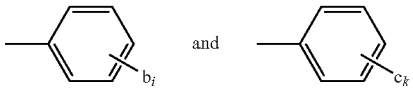
which are independent from each other and each may be as follows:
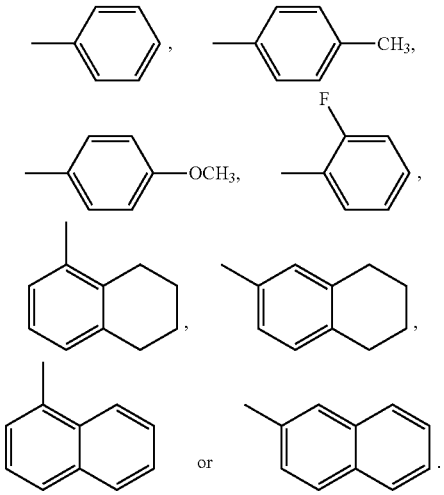
The above-mentioned general formula (1) further has the following partial structure:
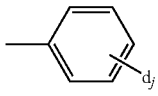
which may be as follows:
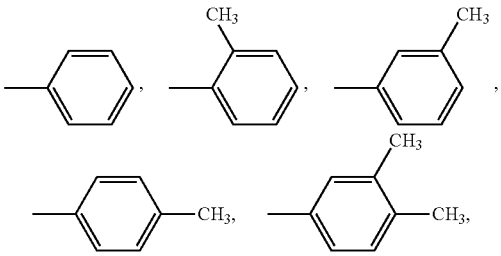
-continued
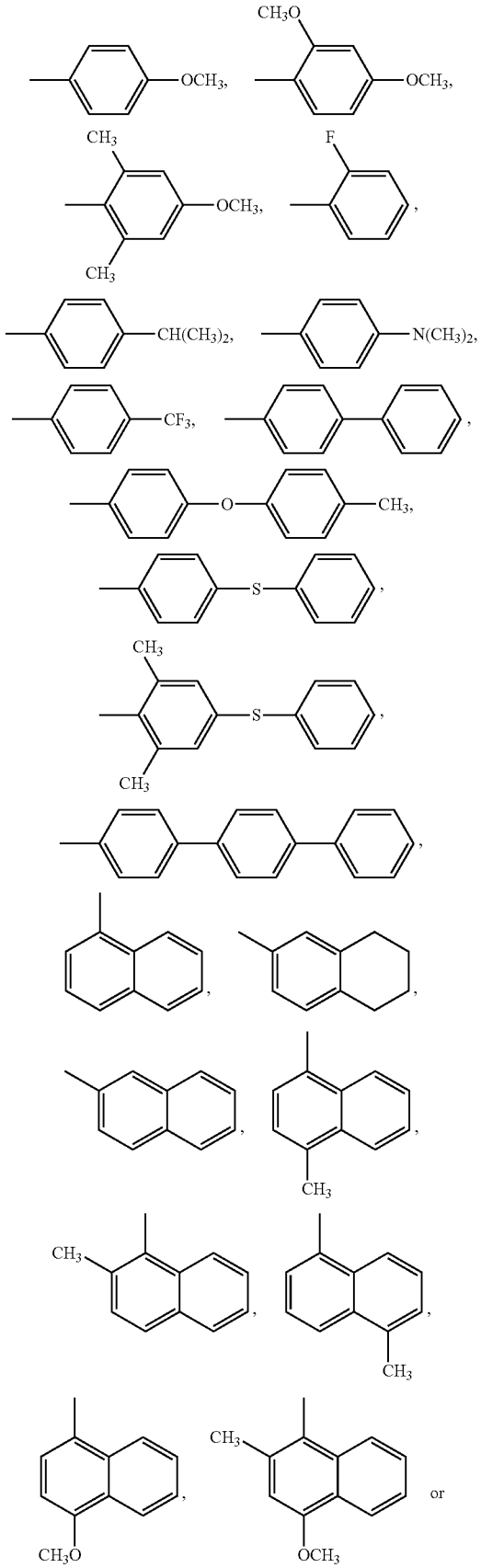

-continued
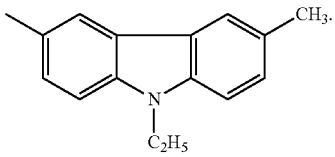
$Ar^4$ or $Ar^5$ in the above-mentioned general formula (1) may be the following substituents:
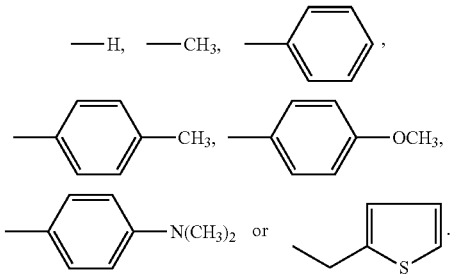
$Ar^5$ or $Ar^4$ in the above-mentioned general formula (1) also may be the following substituents:
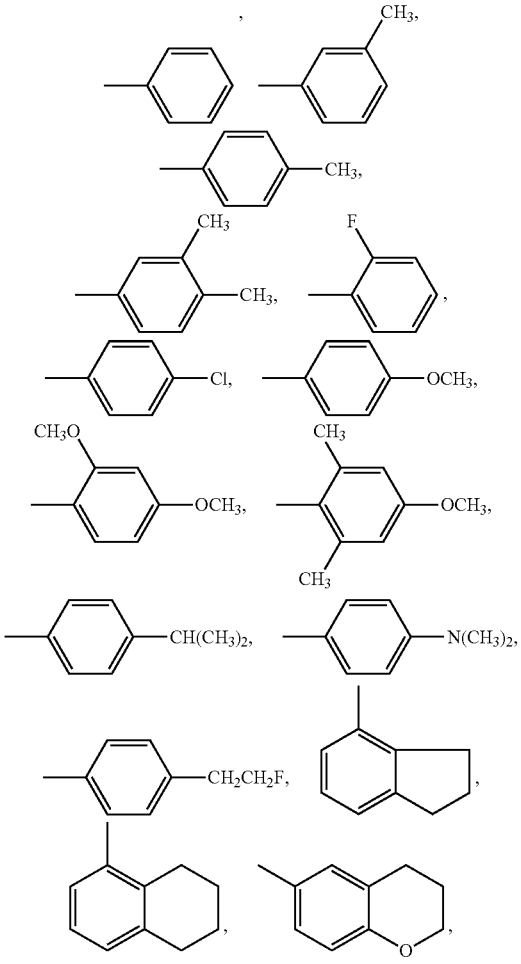
-continued
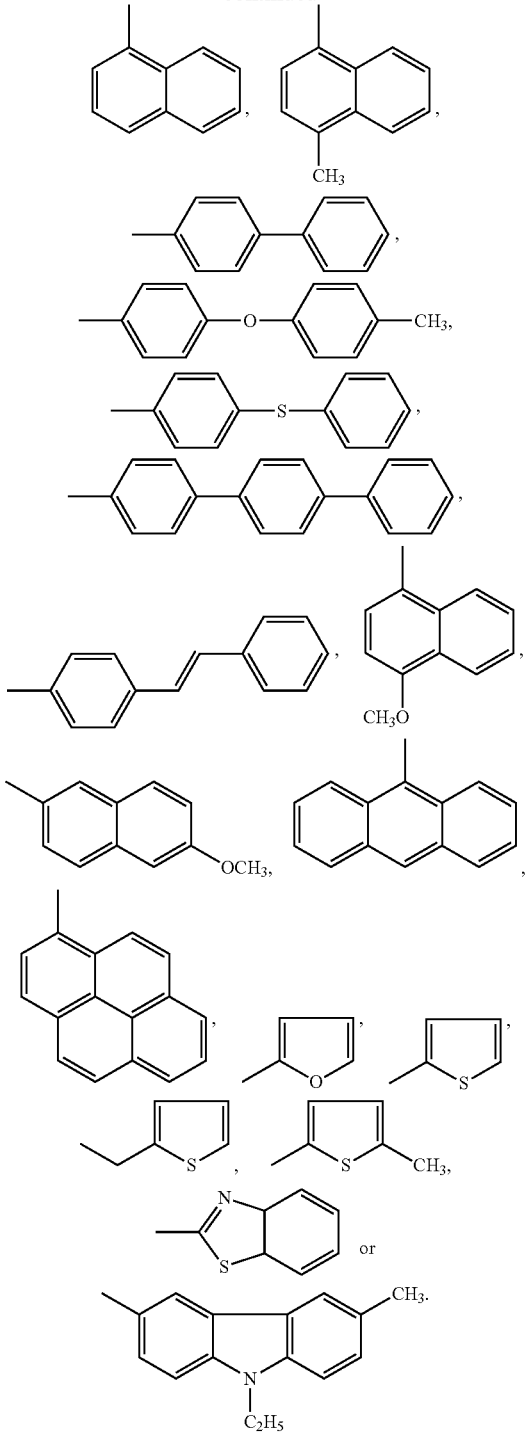
$Ar^4$ and $Ar^5$ in the abovementioned general formula (1) bind to each other by means of an atom or an atom group, and form the following ring structures:
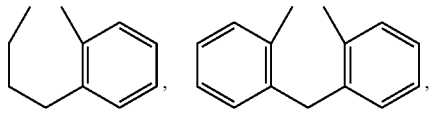

-continued
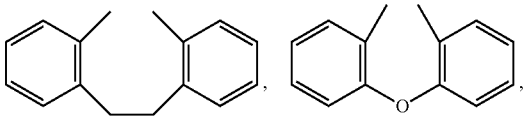
-continued
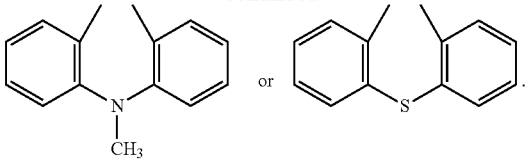
Examples of the enamine-type compound represented by the general formula (1) will be listed in Table 1 below.

| Comp. No. | b | c | 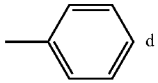 d | 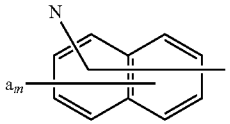 | $Ar^4$ | $Ar^5$ |
|---|---|---|---|---|---|---|
| 1-1 | H | H | 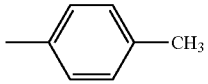 | 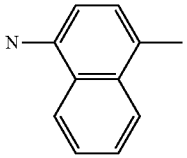 | H | 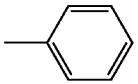 |
| 1-2 | H | H | 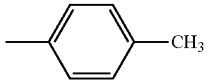 | 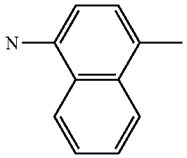 | H | 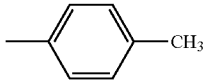 |
| 1-3 | H | H | 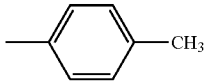 | 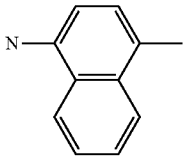 | —$CH_3$ | 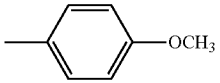 |
| 1-4 | H | H | 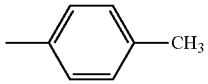 | 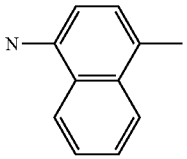 | H | 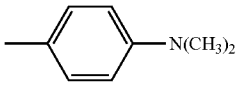 |
| 1-5 | H | H | 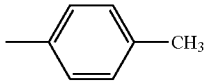 | 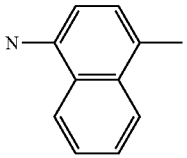 | H | 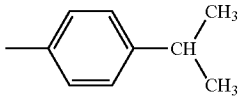 |

-continued
| Comp. No. | b | c | 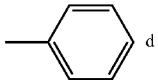 d | 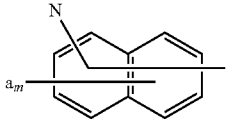 | $Ar^4$ | $Ar^5$ |
|---|---|---|---|---|---|---|
| 1-6 | H | H | 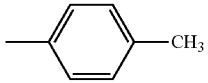 | 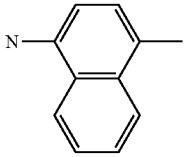 | H | 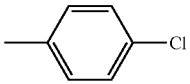 |
| 1-7 | H | H | 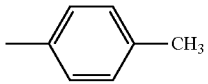 | 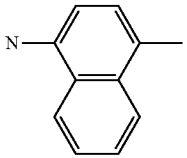 | —$CH_3$ | 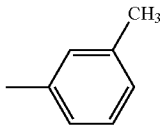 |
| 1-8 | H | H | 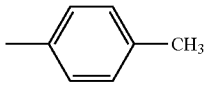 | 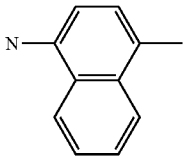 | H | 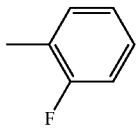 |
| 1-9 | H | H | 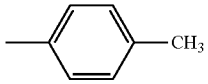 | 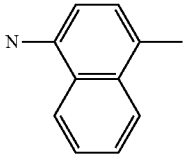 | —$CH_3$ | 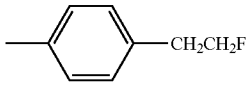 |
| 1-10 | H | H | 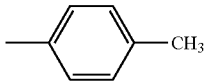 | 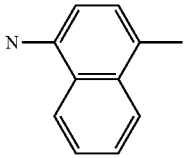 | —$CH_3$ | 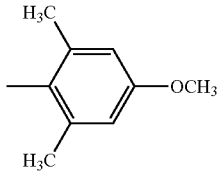 |

-continued
| Comp. No. | b | c | 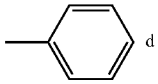 d | 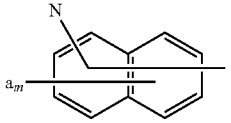 | $Ar^4$ | $Ar^5$ |
|---|---|---|---|---|---|---|
| 1-11 | H | H | 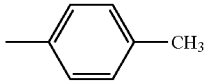 | 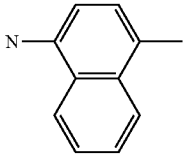 | H | 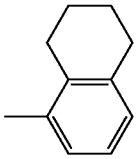 |
| 1-12 | H | H | 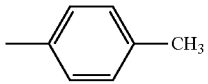 | 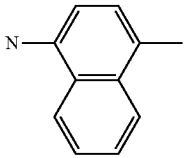 | H | 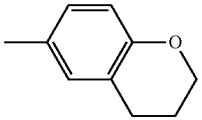 |
| 1-13 | H | H | 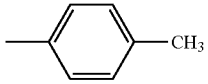 | 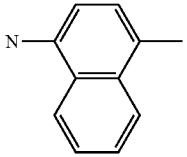 | H | 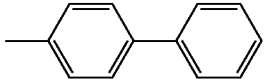 |
| 1-14 | H | H | 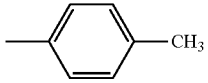 | 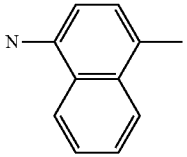 | H | 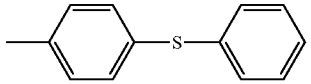 |
| 1-15 | H | H | 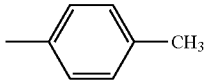 | 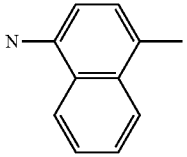 | H | 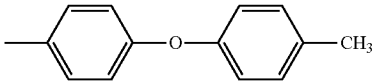 |

-continued
| Comp. No. | b | c | 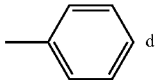 d | 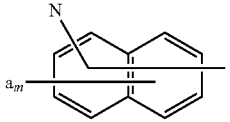 | $Ar^4$ | $Ar^5$ |
|---|---|---|---|---|---|---|
| 1-16 | H | H | 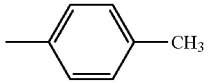 | 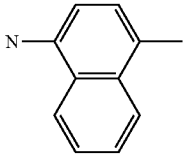 | —$CH_3$ | 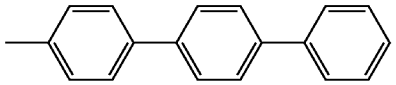 |
| 1-17 | H | H | 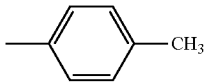 | 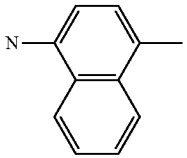 | H | 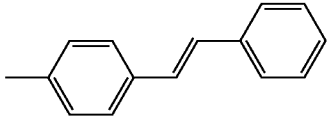 |
| 1-18 | H | H | 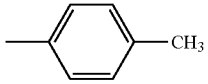 | 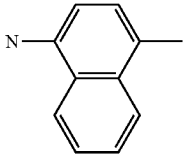 | —$CH_3$ | 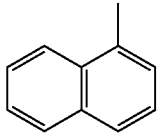 |
| 1-19 | H | H | 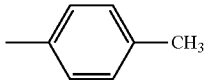 | 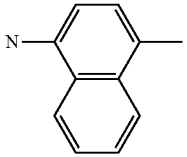 | H | 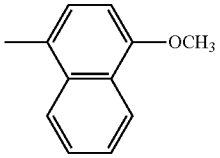 |
| 1-20 | H | H | 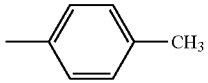 | 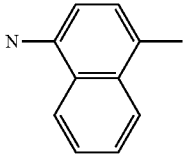 | H | 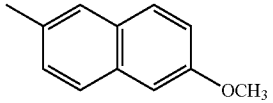 |

-continued
| Comp. No. | b | c | 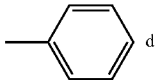 d | 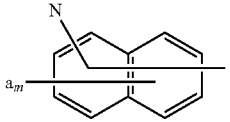 | $Ar^4$ | $Ar^5$ |
|---|---|---|---|---|---|---|
| 1-21 | H | H | 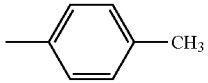 | 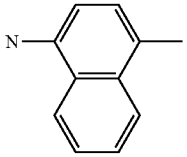 | H | 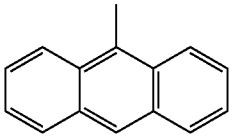 |
| 1-22 | H | H | 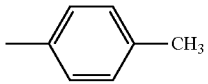 | 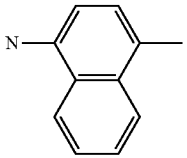 | H | 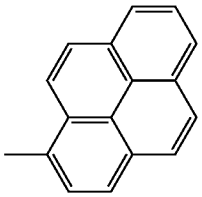 |
| 1-23 | H | H | 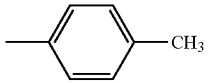 | 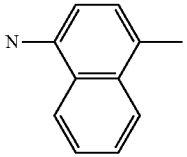 | —$CH_3$ | 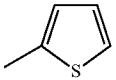 |
| 1-24 | H | H | 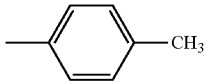 | 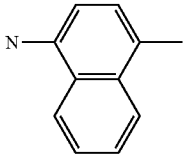 | —$CH_3$ | 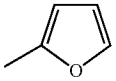 |
| 1-25 | H | H | 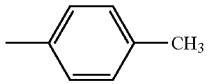 | 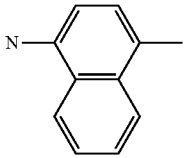 | H | 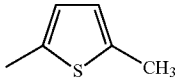 |

-continued
| Comp. No. | b | c | 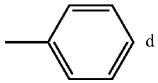 d | 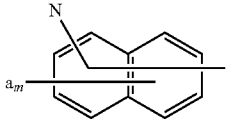 | $Ar^4$ | $Ar^5$ |
|---|---|---|---|---|---|---|
| 1-26 | H | H | 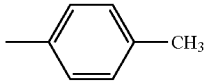 | 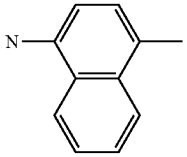 | H | 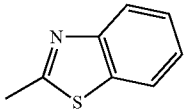 |
| 1-27 | H | H | 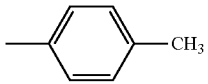 | 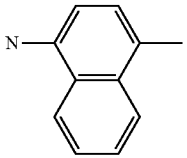 | H | 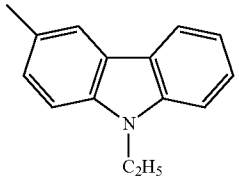 |
| 1-28 | H | H | 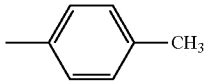 | 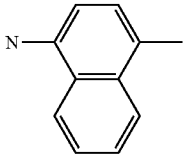 | 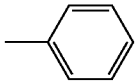 | 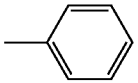 |
| 1-29 | H | H | 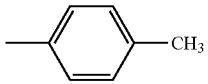 | 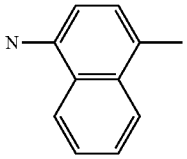 | 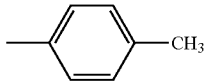 | 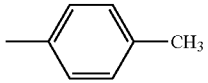 |
| 1-30 | H | H | 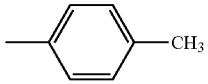 | 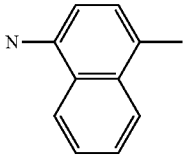 | 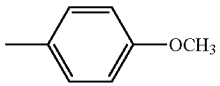 | 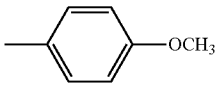 |

-continued
| Comp. No. | b | c | 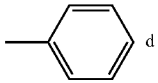 d | 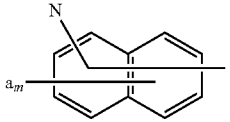 | $Ar^4$ | $Ar^5$ |
|---|---|---|---|---|---|---|
| 1-31 | H | H | 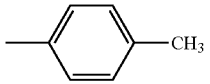 | 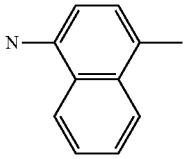 | 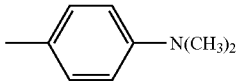 | 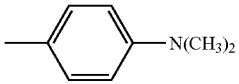 |
| 1-32 | H | H | 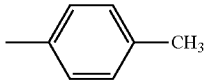 | 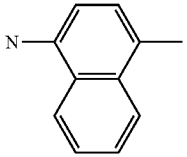 | 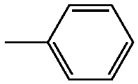 | 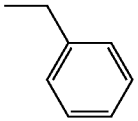 |
| 1-33 | H | H | 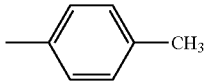 | 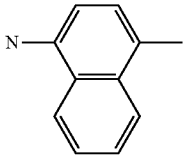 | 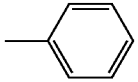 | 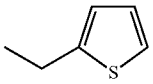 |
| 1-34 | H | H | 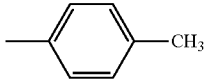 | 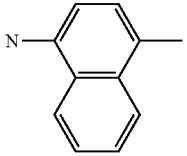 | 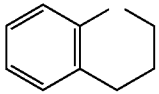 | |
| 1-35 | H | H | 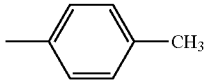 | 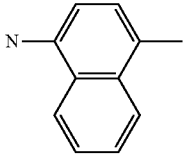 | 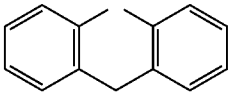 | |

-continued
| Comp. No. | b | c | 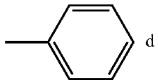 d | 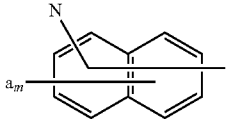 | $Ar^4$ | $Ar^5$ |
|---|---|---|---|---|---|---|
| 1-36 | H | H | 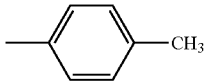 | 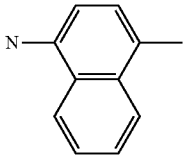 | | 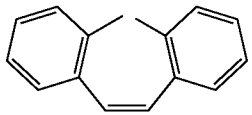 |
| 1-37 | H | H | 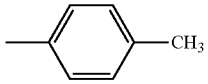 | 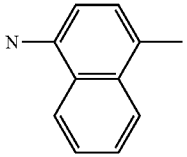 | | 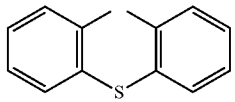 |
| 1-38 | H | H | 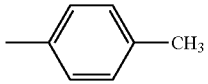 | 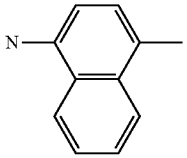 | | 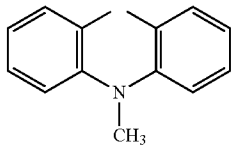 |
| 1-39 | H | H | 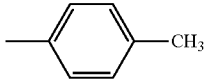 | 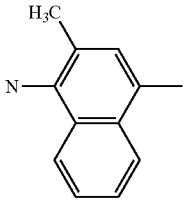 | H | 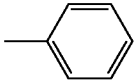 |
| 1-40 | H | H | 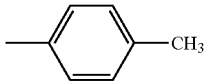 | 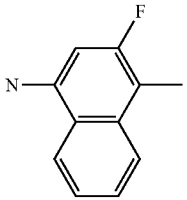 | H | 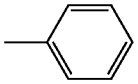 |

-continued
| Comp. No. | b | c | 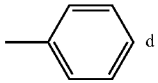 d | 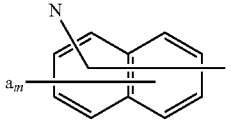 | $Ar^4$ | $Ar^5$ |
|---|---|---|---|---|---|---|
| 1-41 | H | H | 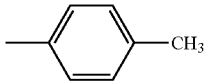 | 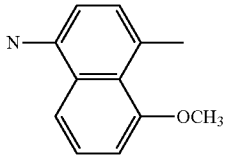 | H | 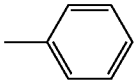 |
| 1-42 | H | H | 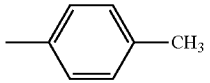 | 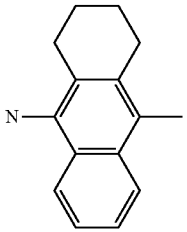 | H | 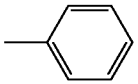 |
| 1-43 | H | H | 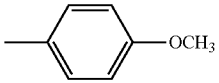 | 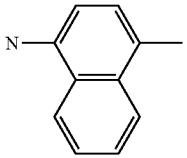 | H | 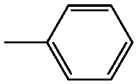 |
| 1-44 | H | H | 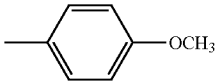 | 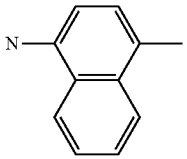 | H | 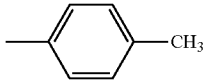 |
| 1-45 | H | H | 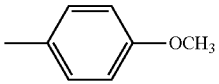 | 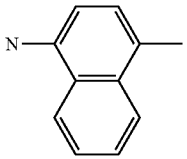 | —$CH_3$ | 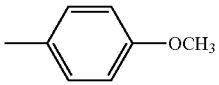 |

-continued
| Comp. No. | b | c | 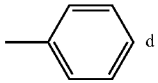 | 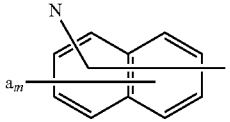 | $Ar^4$ | $Ar^5$ |
|---|---|---|---|---|---|---|
| 1-46 | H | H | 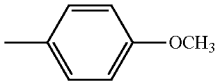 | 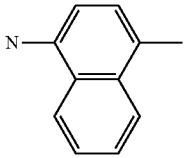 | H | 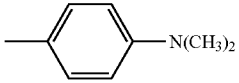 |
| 1-47 | H | H | 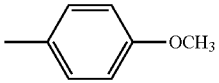 | 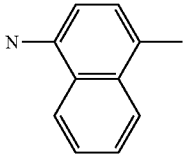 | H | 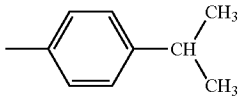 |
| 1-48 | H | H | 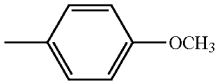 | 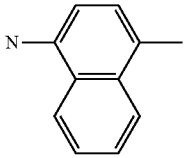 | —$CH_3$ | 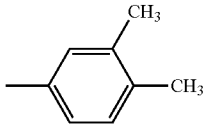 |
| 1-49 | H | H | 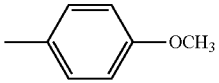 | 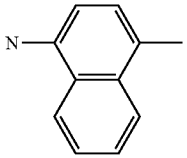 | H | 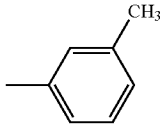 |
| 1-50 | H | H | 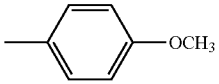 | 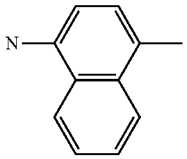 | H | 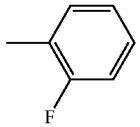 |

-continued
| Comp. No. | b | c | 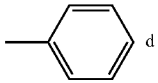 d | 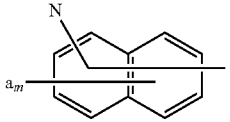 | $Ar^4$ | $Ar^5$ |
|---|---|---|---|---|---|---|
| 1-51 | H | H | 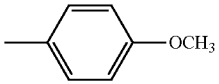 | 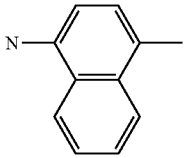 | H | 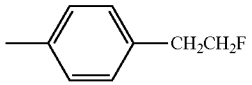 |
| 1-52 | H | H | 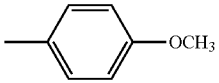 | 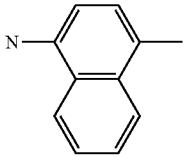 | H | 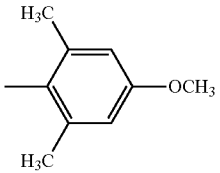 |
| 1-53 | H | H | 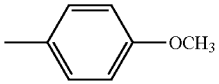 | 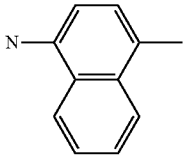 | H | 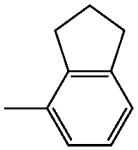 |
| 1-54 | H | H | 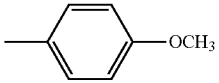 | 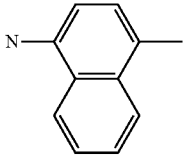 | H | 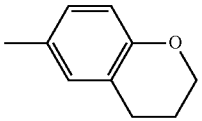 |
| 1-55 | H | H | 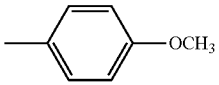 | 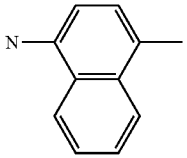 | H | 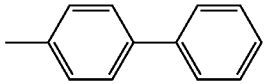 |

-continued
| Comp. No. | b | c | 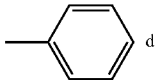 d | 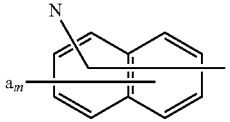 | $Ar^4$ | $Ar^5$ |
|---|---|---|---|---|---|---|
| 1-56 | H | H | 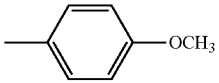 | 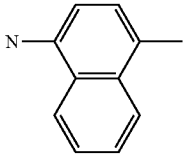 | H | 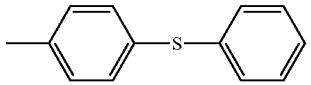 |
| 1-57 | H | H | 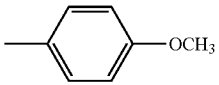 | 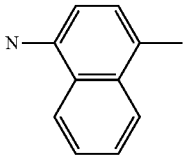 | H | 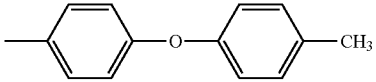 |
| 1-58 | H | H | 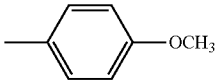 | 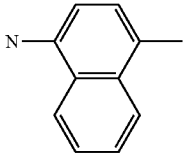 | H | 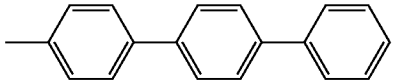 |
| 1-59 | H | H | 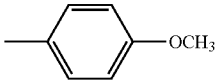 | 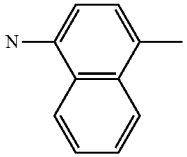 | H | 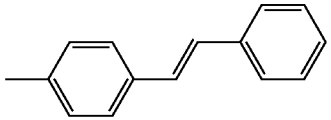 |
| 1-60 | H | H | 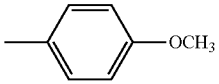 | 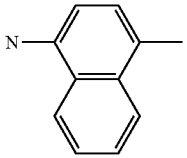 | H | 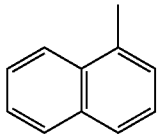 |

-continued
| Comp. No. | b | c | 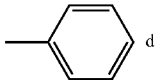 d | 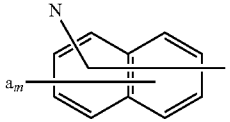 | $Ar^4$ | $Ar^5$ |
|---|---|---|---|---|---|---|
| 1-61 | H | H | 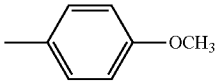 | 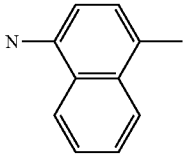 | H | 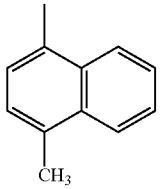 |
| 1-62 | H | H | 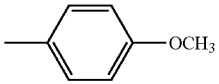 | 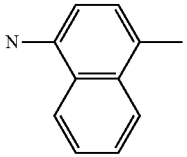 | H | 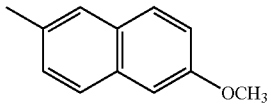 |
| 1-63 | H | H | 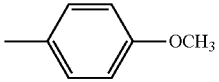 | 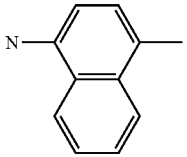 | H | 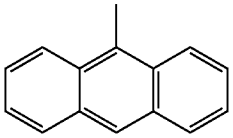 |
| 1-64 | H | H | 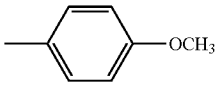 | 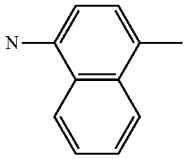 | H | 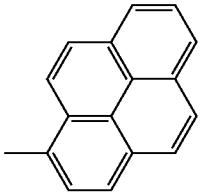 |
| 1-65 | H | H | 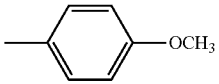 | 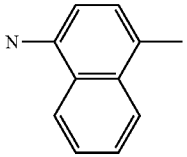 | H | 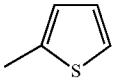 |

-continued
| Comp. No. | b | c | 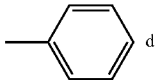 | 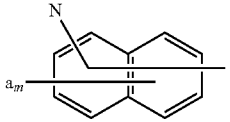 | $Ar^4$ | $Ar^5$ |
|---|---|---|---|---|---|---|
| 1-66 | H | H | 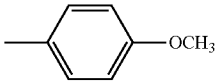 | 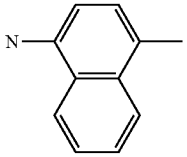 | H | 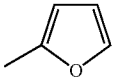 |
| 1-67 | H | H | 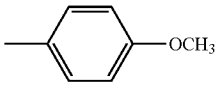 | 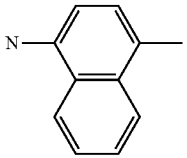 | —$CH_3$ | 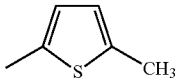 |
| 1-68 | H | H | 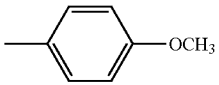 | 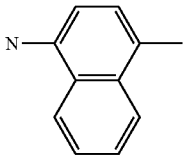 | —$CH_3$ | 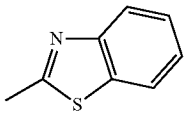 |
| 1-69 | H | H | 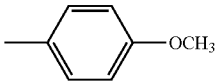 | 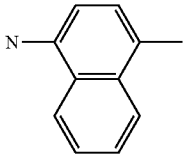 | —$CH_3$ | 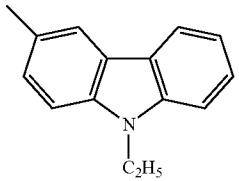 |
| 1-70 | H | H | 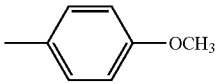 | 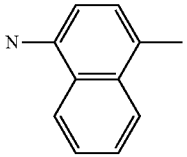 | 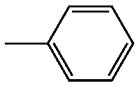 | 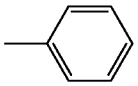 |

-continued
| Comp. No. | b | c | 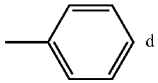 d | 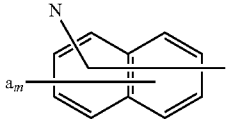 | $Ar^4$ | $Ar^5$ |
|---|---|---|---|---|---|---|
| 1-71 | H | H | 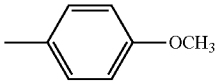 | 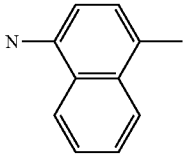 | 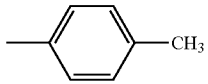 | 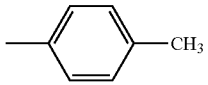 |
| 1-72 | H | H | 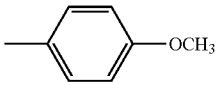 | 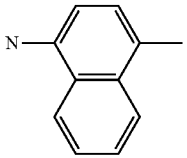 | 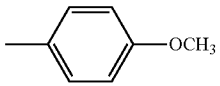 | 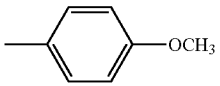 |
| 1-73 | H | H | 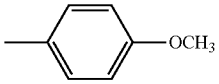 | 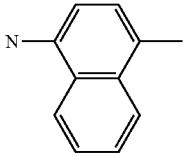 | 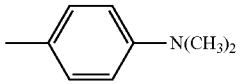 | 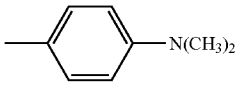 |
| 1-74 | H | H | 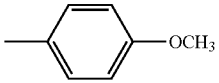 | 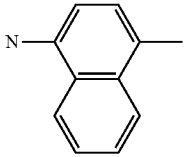 | 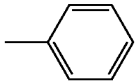 | 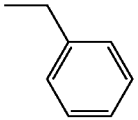 |
| 1-75 | H | H | 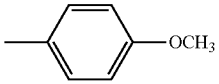 | 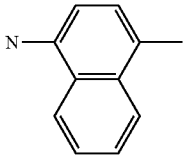 | 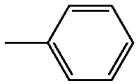 | 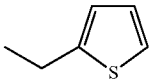 |

-continued
| Comp. No. | b | c | 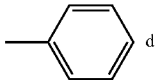 d | 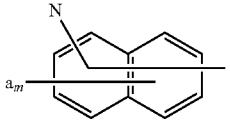 | $Ar^4$ | $Ar^5$ |
|---|---|---|---|---|---|---|
| 1-76 | H | H | 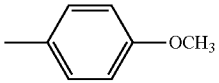 | 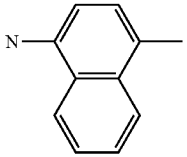 | | 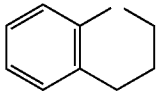 |
| 1-77 | H | H | 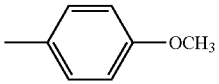 | 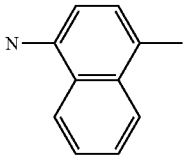 | | 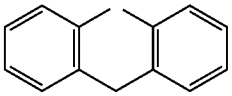 |
| 1-78 | H | H | 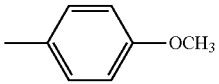 | 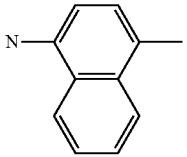 | | 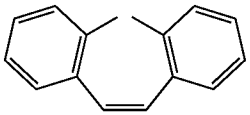 |
| 1-79 | H | H | 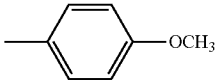 | 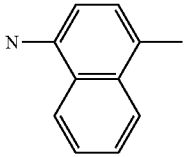 | | 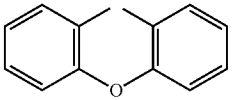 |
| 1-80 | H | H | 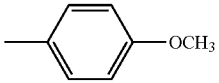 | 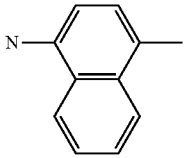 | | 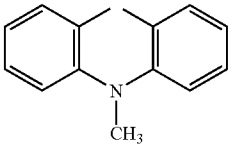 |

-continued
| Comp. No. | b | c | 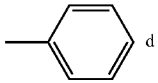 d | 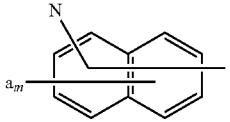 | $Ar^4$ | $Ar^5$ |
|---|---|---|---|---|---|---|
| 1-81 | H | H | 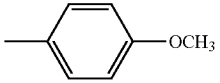 | 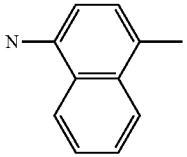 | H | 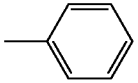 |
| 1-82 | H | H | 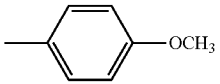 | 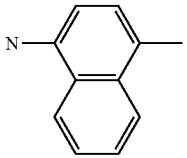 | 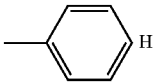 | 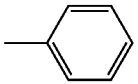 |
| 1-83 | H | H | 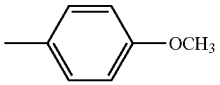 | 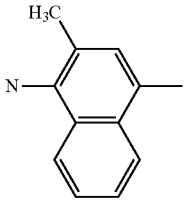 | H | 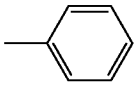 |
| 1-84 | H | H | 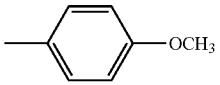 | 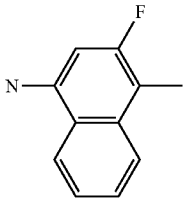 | H | 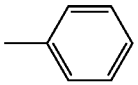 |
| 1-85 | H | H | 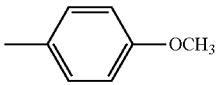 | 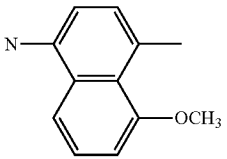 | H | 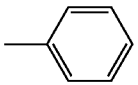 |

-continued
| Comp. No. | b | c | 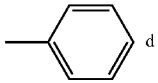 d | 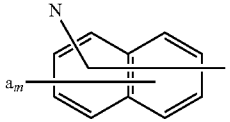 | $Ar^4$ | $Ar^5$ |
|---|---|---|---|---|---|---|
| 1-86 | H | H | 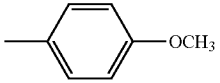 | 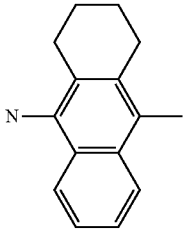 | H | 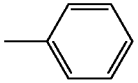 |
| 1-87 | H | H | 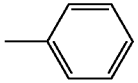 | 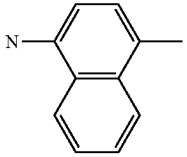 | H | 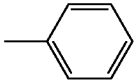 |
| 1-88 | H | H | 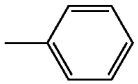 | 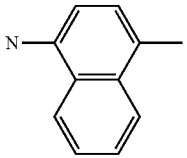 | $—CH_3$ | 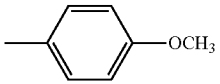 |
| 1-89 | H | H | 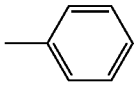 | 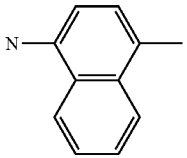 | 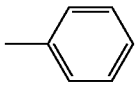 | 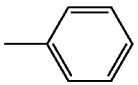 |
| 1-90 | H | H | 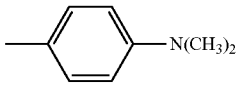 | 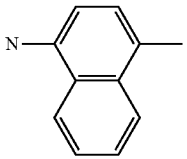 | H | 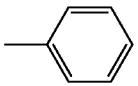 |

-continued
| Comp. No. | b | c | 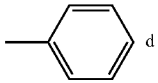 d | 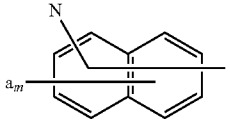 | $Ar^4$ | $Ar^5$ |
|---|---|---|---|---|---|---|
| 1-91 | H | H | 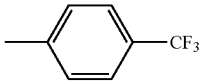 | 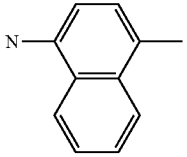 | H | 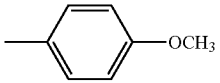 |
| 1-92 | H | H | 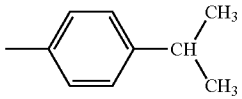 | 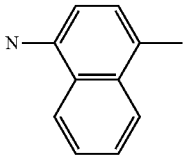 | 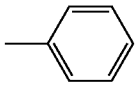 | 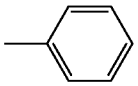 |
| 1-93 | H | H | 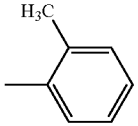 | 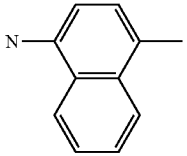 | H | 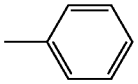 |
| 1-94 | H | H | 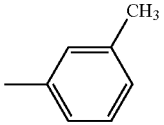 | 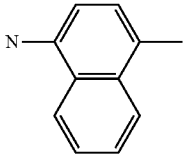 | H | 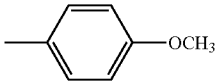 |
| 1-95 | H | H | 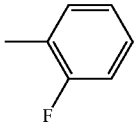 | 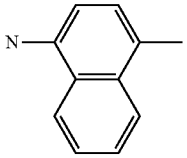 | 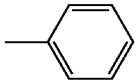 | 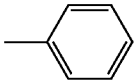 |

-continued
| Comp. No. | b | c | 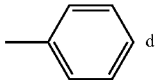 d | 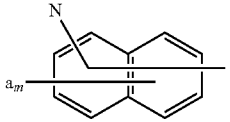 | $Ar^4$ | $Ar^5$ |
|---|---|---|---|---|---|---|
| 1-96 | H | H | 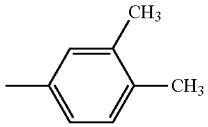 | 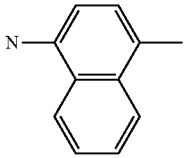 | H | 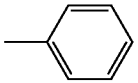 |
| 1-97 | H | H | 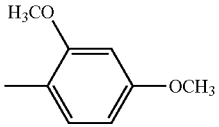 | 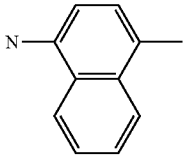 | —$CH_3$ | 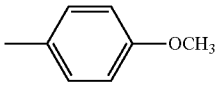 |
| 1-98 | H | H | 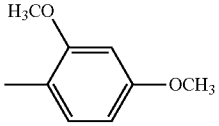 | 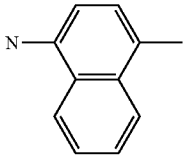 | 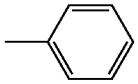 | 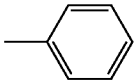 |
| 1-99 | H | H | 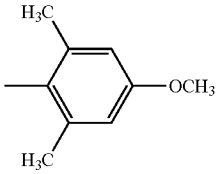 | 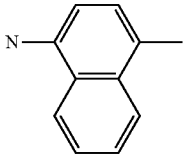 | H | 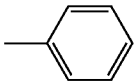 |
| 1-100 | H | H | 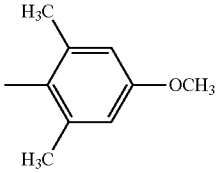 | 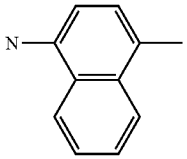 | H | 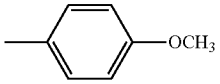 |

-continued
| Comp. No. | b | c | 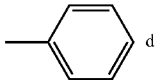 d | 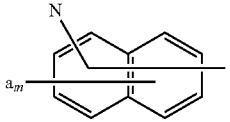 | $Ar^4$ | $Ar^5$ |
|---|---|---|---|---|---|---|
| 1-101 | H | H | 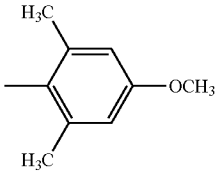 | 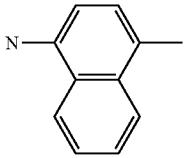 | 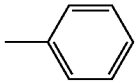 | 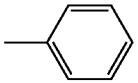 |
| 1-102 | H | H | 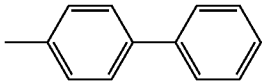 | 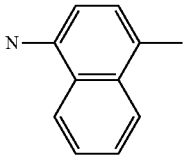 | H | 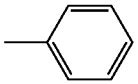 |
| 1-103 | H | H | 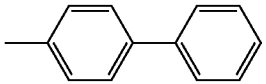 | 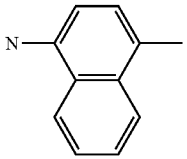 | —$CH_3$ | 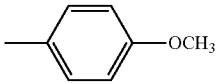 |
| 1-104 | H | H | 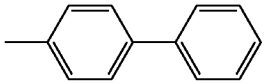 | 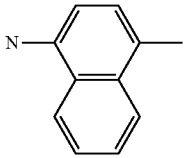 | 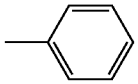 | 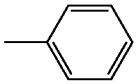 |
| 1-105 | H | H | 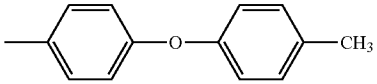 | 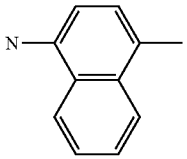 | H | 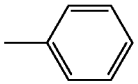 |

-continued
| Comp. No. | b | c | 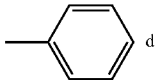 d | 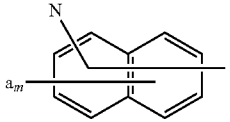 | $Ar^4$ | $Ar^5$ |
|---|---|---|---|---|---|---|
| 1-106 | H | H | 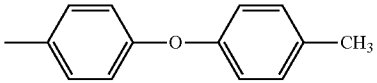 | 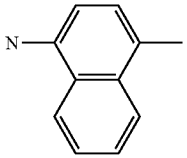 | H | 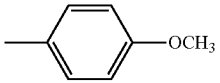 |
| 1-107 | H | H | 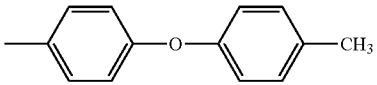 | 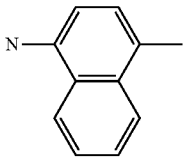 | —$CH_3$ | 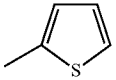 |
| 1-108 | H | H | 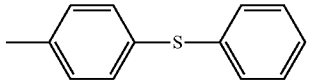 | 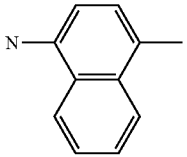 | H | 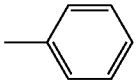 |
| 1-109 | H | H | 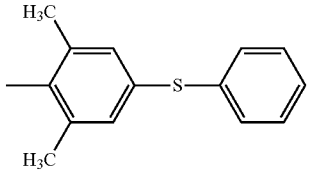 | 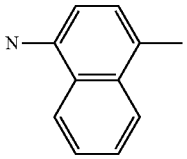 | —$CH_3$ | 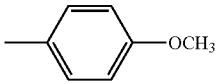 |
| 1-110 | H | H | 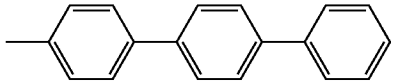 | 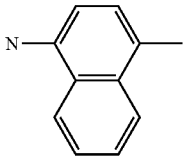 | —$CH_3$ | 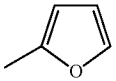 |

-continued
| Comp. No. | b | c | 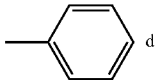 d | 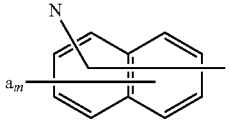 | $Ar^4$ | $Ar^5$ |
|---|---|---|---|---|---|---|
| 1-111 | H | H | 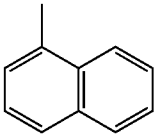 | 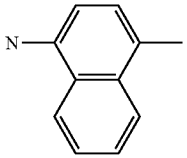 | H | 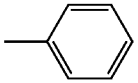 |
| 1-112 | H | H | 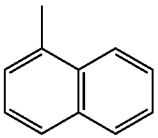 | 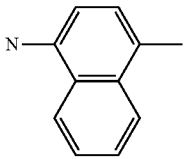 | $—CH_3$ | 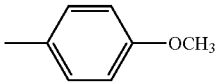 |
| 1-113 | H | H | 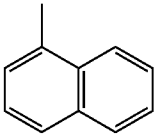 | 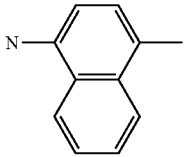 | H | 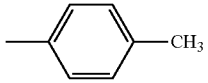 |
| 1-114 | H | H | 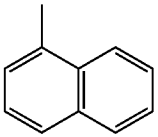 | 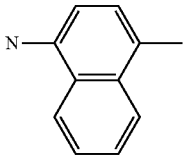 | $—CH_3$ | 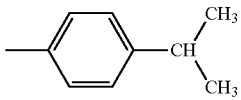 |
| 1-115 | H | H | 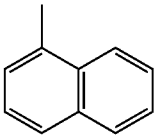 | 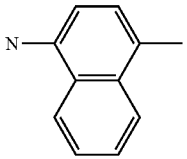 | H | 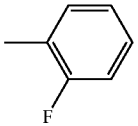 |

-continued
| Comp. No. | b | c | 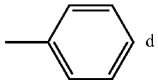 d | 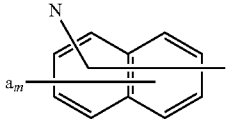 | $Ar^4$ | $Ar^5$ |
|---|---|---|---|---|---|---|
| 1-116 | H | H | 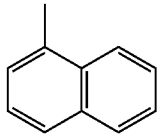 | 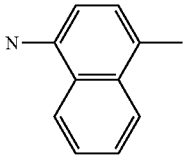 | $—CH_3$ | 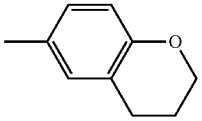 |
| 1-117 | H | H | 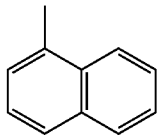 | 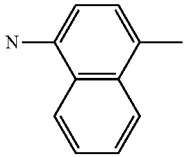 | $—CH_3$ | 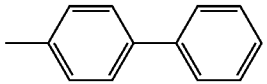 |
| 1-118 | H | H | 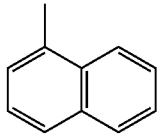 | 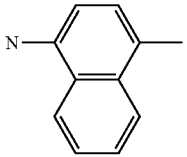 | $—CH_3$ | 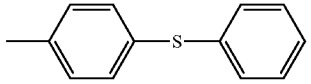 |
| 1-119 | H | H | 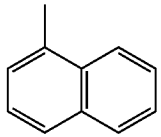 | 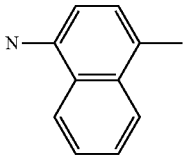 | H | 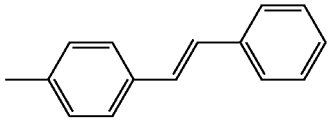 |
| 1-120 | H | H | 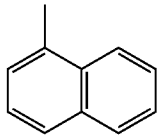 | 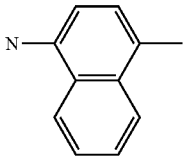 | $—CH_3$ | 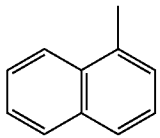 |

-continued
| Comp. No. | b | c | 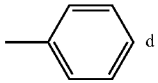 d | 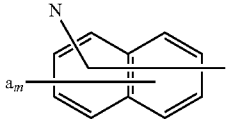 | $Ar^4$ | $Ar^5$ |
|---|---|---|---|---|---|---|
| 1-121 | H | H | 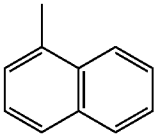 | 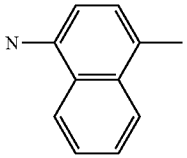 | $—CH_3$ | 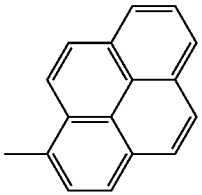 |
| 1-122 | H | H | 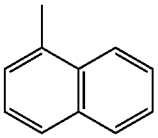 | 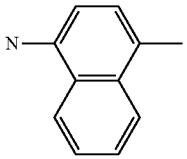 | $—CH_3$ | 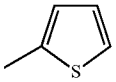 |
| 1-123 | H | H | 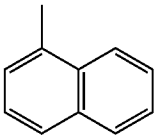 | 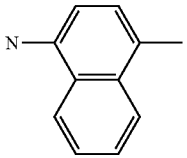 | H | 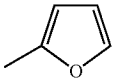 |
| 1-124 | H | H | 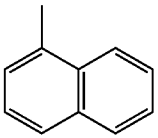 | 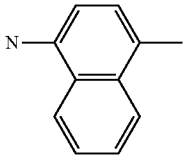 | 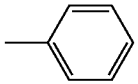 | 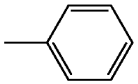 |
| 1-125 | H | H | 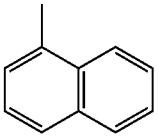 | 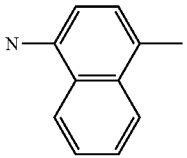 | 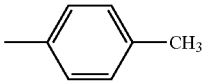 | 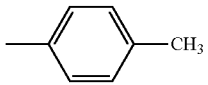 |

-continued
| Comp. No. | b | c | 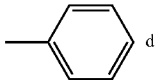 d | 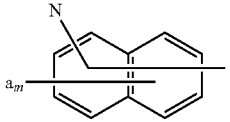 | $Ar^4$ | $Ar^5$ |
|---|---|---|---|---|---|---|
| 1-126 | H | H | 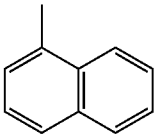 | 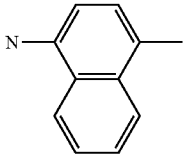 | 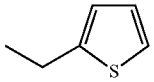 | 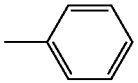 |
| 1-127 | H | H | 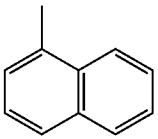 | 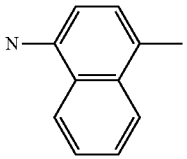 | 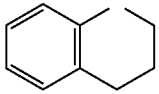 | |
| 1-128 | H | H | 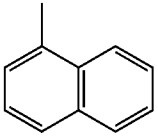 | 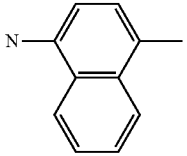 | 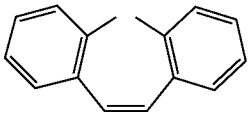 | |
| 1-129 | H | H | 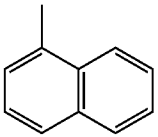 | 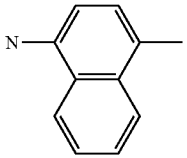 | 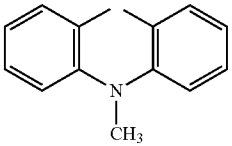 | |
| 1-130 | H | H | 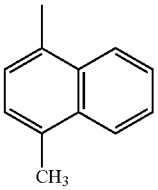 | 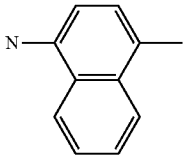 | H | 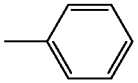 |

-continued
| Comp. No. | b | c | 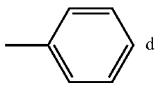 d | 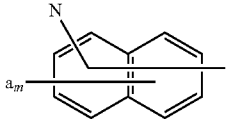 | $Ar^4$ | $Ar^5$ |
|---|---|---|---|---|---|---|
| 1-131 | H | H | 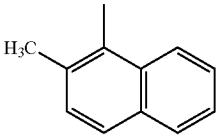 | 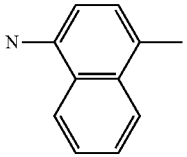 | H | 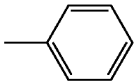 |
| 1-132 | H | H | 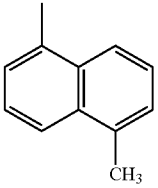 | 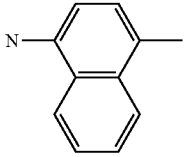 | H | 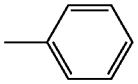 |
| 1-133 | H | H | 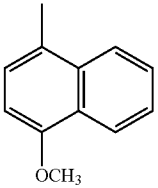 | 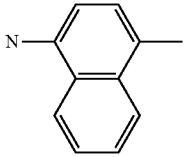 | H | 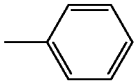 |
| 1-134 | H | H | 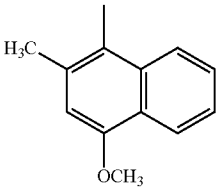 | 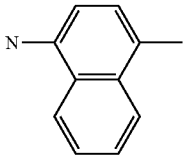 | H | 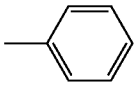 |
| 1-135 | H | H | 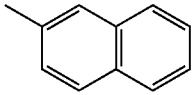 | 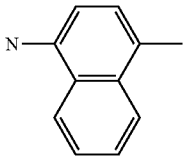 | H | 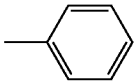 |

-continued
| Comp. No. | b | c | 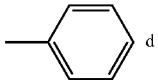 d | 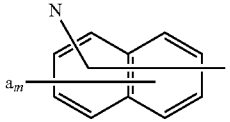 | $Ar^4$ | $Ar^5$ |
|---|---|---|---|---|---|---|
| 1-136 | H | H | 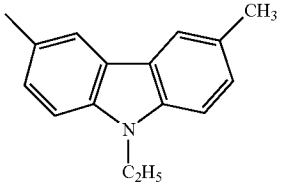 | 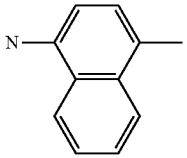 | 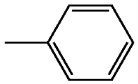 | 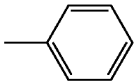 |
| 1-137 | H | H | 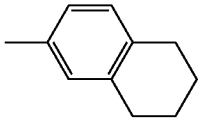 | 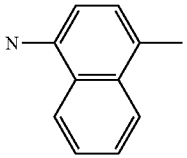 | H | 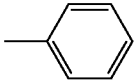 |
| 1-138 | p-$CH_3$ | p-$CH_3$ | 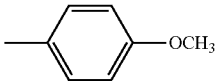 | 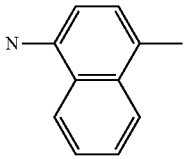 | H | 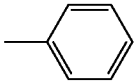 |
| 1-139 | p-$OCH_3$ | p-$OCH_3$ | 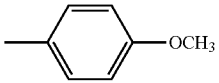 | 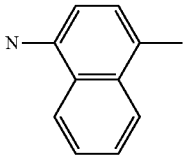 | H | 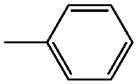 |
| 1-140 | o-F | o-F | 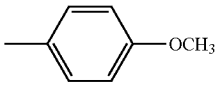 | 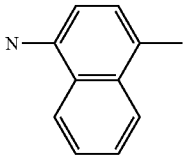 | H | 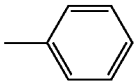 |

-continued
| Comp. No. | b | c | d | 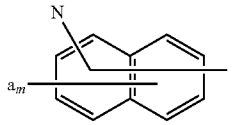 | $Ar^4$ | $Ar^5$ |
|---|---|---|---|---|---|---|
| 1-141 | 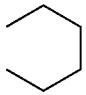 | 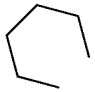 | 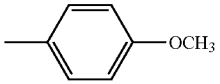 | 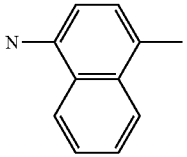 | H | 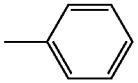 |
| 1-142 | p-$OCH_3$ | H | 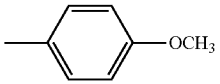 | 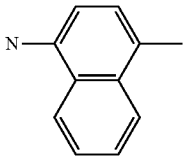 | H | 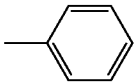 |
| 1-143 | 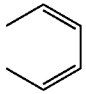 | 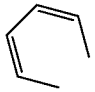 | 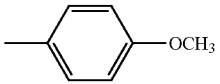 | 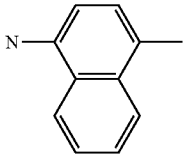 | H | 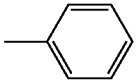 |

Among these Compounds, Compounds 1-1, 1-43 and 1-111 are preferable for an electric property and film strength.

Incidentally, the above-listed Compounds can be formed by a method disclosed in Japanese Unexamined Patent Application Publication No. 2004-151666.

The single-layer electrophotographic photoreceptor of the present invention comprises: the enamine-type compound that functions as both the charge generation material and the charge transport material; and the perylene-type compound that functions as both the electron-transport material and the sensitizer and is represented by the following general formula (2):

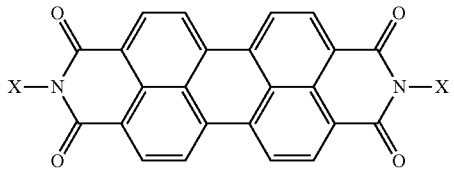

(2)

wherein X represents a hydrogen atom, an alkyl group, an alkoxy group or an aryl group which may be substituted.

Examples of the perylene-type compound represented by the abovementioned general formula (2) will be listed in Table 2 below.

| perylene-type compound | Chemical structure |
|---|---|
| Compound 2-1 | 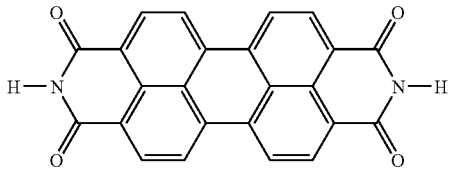 |
| Compound 2-2 | 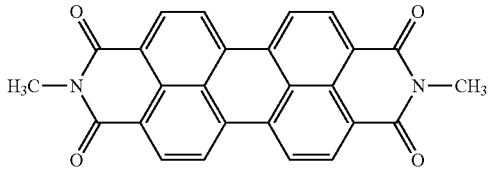 (5) |
| Compound 2-3 | 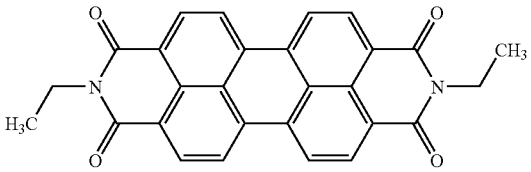 |
| Compound 2-4 | 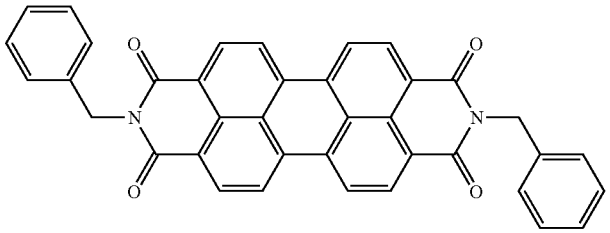 |
| Compound 2-5 | 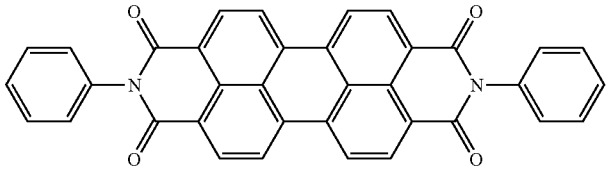 |

-continued

| perylene-type compound | Chemical structure |
|---|---|
| Compound 2-6 | 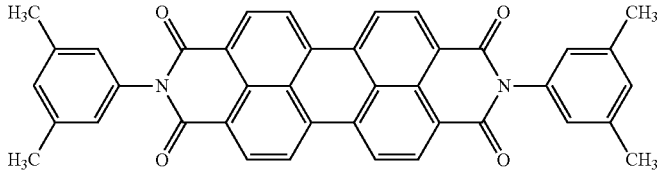 (3) |
| Compound 2-7 | 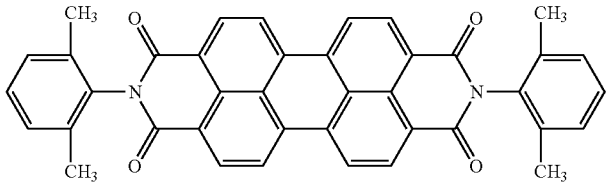 (4) |

Although some Compounds of the perylene-type compound generate electrical charges, an amount of the electrical charges is low in a short wavelength area, and therefore the perylene-type compound can function mainly as the electron-transport material.

Since the enamine-type compound is not capable of transporting electrons, it is understood that the enamine-type compound generates and transports the electrical charges and the perylene-type compound transports electrons.

Among the Compounds of the perylene-type compound, Compounds 2-2, 2-6 and 2-7 are preferable, as the electron-transport material and the sensitizer, for an electron-transport function and a function as the sensitizer.

The perylene-type compound used in the present invention is prepared, for example, as follows.

A perylene-type compound is usually prepared by reacting a perylene tetracarboxylic acid anhydride with a compound having a primary amino group. A synthesized perylene-type compound is better to be purified by a conventionally known purification method since it contains an unreacted amine compound (e.g. 3,5-xylidine or the like) and a catalyst (e.g. zinc chloride or the like).

Examples of the conventionally known purification method include: an aqueous washing with use of a solution such as water, an acidic solution, an alkaline solution, or the like; an acid washing; an alkaline washing; and the like, and two or more kinds of the above-mentioned washings may be carried out.

It is preferable to carry out the aqueous washing with use of water after the acid washing and the alkaline washing are carried out. Namely, the acid washing neutralizes and eliminates the unreacted amine compound, such as xylidine or the like, remained in the synthesized perylene-type compound, and then the alkaline washing decomposes and eliminates the catalyst such as zinc chloride or the like, and then the aqueous washing follows.

The binder resin is used in the single-layer photosensitive layer for the purpose of enhancing mechanical strength, durability, and the like of the single-layer photosensitive layer, and any resin, used in a relevant field, having a binding property can be used.

Examples of the binder resin include: a thermoplastic resin such as a vinyl-based resin, for example, polymethyl methacrylate, polystyrene, polyvinyl chloride, and the like, polycarbonate, polyester, polyester carbonate, polysulphone, polyallylate, polyamide, a methacryl resin, an acryl resin, polyether, polyacrylamide, polyphenylene oxide, and the like; a heat-hardening resin such as a phenoxy resin, an epoxy resin, a silicon resin, polyurethane, a phenol resin, an alkyd resin, a melamine resin, phenoxy resin, polyvinyl butyral, polyvinyl formal, and the like; a partially cross-linked resin of the above-mentioned resins; a copolymer resin (e.g. an insulating resin such as a polyvinyl chloride acetate copolymer resin, a polyvinyl chloride acetate maleic acid anhydride resin, an acrylonitrile-styrene copolymer resin, and the like) that contains two or more constituent units contained in the above-mentioned resins; and the like. These examples of the binder resin can be used solely, or the two or more examples can be mixed.

Among these resins, polystyrene, polycarbonate, polyalylate, and polyphenylene oxide are preferable for an electrical insulating property due to a volume resistance value of $10^{13}\Omega$ or more, film formation, a potential characteristic, and the like, and polycarbonate is more preferable for strength.

A content ratio of the enamine-type compound and the perylene-type compound contained in the photosensitive layer of the present invention is not particularly limited. However, a ratio H/E between a weight H of the enamine-type compound and a weight E of the perylene-type compound ranging from 1/1 to 10/1 inclusive is preferable. In the case where the ratio H/E is less than 1/1, the perylene-type compound functions as a trap level and could induce sensitivity of the single-layer photosensitive layer to decrease. In the case where the ratio H/E is more than 10/1, the single-layer photosensitive layer could not have sufficient sensitivity.

Moreover, a content of the enamine-type compound in the it; single-layer photosensitive layer ranging from 5% by weight to 70% by weight inclusive is desirable.

In the case where the enamine-type compound content exceeds 70% by weight, film strength of the enamine-type compound could decrease. In the case where the enamine-type compound content falls below 5% by weight, the enamine-type compound could not transport the electrical charges, and its sensitivity could decrease.

In the meanwhile, a content of the perylene-type compound in the single layer photosensitive layer ranging from 1% by weight to 15% by weight inclusive is desirable.

In the case where the perylene-type compound content exceeds 15% by weight, film strength of the perylene-type compound could decrease. In the case where the perylene-type compound content falls below 1% by weight, the perylene-type compound could not transport the electrons, and its sensitivity could decrease.

A content of the binder resin in the single-layer photosensitive layer ranging from 30% by weight to 80% by weight inclusive is desirable.

In the case where the binder resin content exceeds 80% by weight, a function of the single-layer photosensitive layer could decrease. In the case where the binder resin content falls below 30% by weight, film strength of the single-layer photosensitive layer could decrease.

The single-layer photosensitive layer 140 shown in FIGS. 1 and 2 comprises the enamine-type compound 12, the perylene-type compound 13, and the binder resin 17, and may comprise, if needed, a coating solution that is prepared by dissolving or dispersing an additive, such as an antioxidant or the like, in a proper organic solvent, that is applied to the surface of the conductive substrate 11 or to a surface of the inner layer 18 positioned on the conductive substrate 11, and that is dried so as to eliminate the organic solvent. More specifically, a coating solution for forming the single-layer photosensitive layer is prepared, for example, by dissolving or dispersing a constituent material in a resin solution prepared by dissolving a binder resin in an organic solvent.

Examples of the organic solvent include: aromatic hydrocarbons such as benzene, toluene, xylene, mesitylene, tetralin, diphenylmethane, dimethoxybenzene, dichlorobenzene, and the like; halogenated hydrocarbons such as dichloromethane, dichloroethane, tetrachloropropane, and the like; ethers such as tetrahydrofuran (THF), dioxane, dibenzyl ether, dimethoxymethylether, 1,2-dimethoxyethane, and the like; ketones such as methyl ethyl ketone, cyclohexanone, acetophenone, isophorone, and the like; esters such as methyl benzoate, ethyl acetate, butyl acetate, and the like; sulfur containing solvents such as diphenylsulfide, and the like; fluorinated solvents such as hexafluoroisopropanol, and the like; aprotic polar solvents such as N,N-dimethylformamide, N,N-dimethylacetamide, and the like; and the like. These examples of the organic solvent can be used solely, or the two or more examples can be mixed and used as a mixed solvent. Further, the above-mentioned examples of the organic solvent can be mixed with alcohol, acetonitrile or methyl ethyl ketone, and used as a mixed solvent. Furthermore, among these examples, the non-halogen-type organic solvents are preferable out of respect for a global environment.

As a method for applying the coating solution for forming the single-layer photosensitive layer, a most suitable method should be selected in consideration of a physical property of the coating solution and productivity of the single-layer photosensitive layer. Examples of the application method include a roll coating, a spray coating, a blade coating, a ring coating, an immersion coating, and the like.

The immersion coating forms a layer of the coating solution on the conductive substrate surface, such that the conductive substrate is immersed in the coating solution fully contained in a solution bath, and then pulled up from the coating solution with constant speed or gradually changing speed. Among the examples of the application method, the immersion coating is relatively easy and excellent in productivity and cost of the single-layer photosensitive layer. Therefore, the immersion coating is widely used for preparing an electrophotographic photoreceptor. Incidentally, the immersion coating may use a coating solution dispersing device, typified by an ultrasonic generator, in order to stabilize dispersibility of the coating solution.

The single-layer photosensitive layer may comprise a charge transport material other than the enamine-type compound represented by the general formula (1) in order to enhance a charge-transport function within the scope that an effect of the present invention is not obstructed.

Examples of such a charge transport material include an enamine derivative, a carbazole derivative, an oxazole derivative, an oxadiazole derivative, a thiazole derivative, a thiadiazole derivative, a triazole derivative, an imidazole derivative, an imidazolone derivative, an imidazolidine derivative, a bisimidazolidine derivative, a styryl compound, a hydrazone compound, a polyaromatic compound, an indole derivative, a pyrazoline derivative, an oxazolone derivative, a benzimidazole derivative, a quinazoline derivative, a benzofuran derivative, an acridine derivative, a phenazine derivative, an aminostilbene derivative, a triarylamine derivative, a triarylmethane derivative, a phenylenediamine derivative, a stilbene derivative, a benzene derivative, a polymer having a group(s), as a main chain(s) or a side chain(s), comprising the above-mentioned derivatives and compounds, for example, poly-N-vinylcarbazole, poly-1-vinylpyrene, and poly-9-vinylanthracene, and the like.

The single-layer photosensitive layer may comprise an additive, if needed, used in a relevant field, such as an antioxidant, an ultraviolet absorber, a plasticizer, a leveling agent, and the like.

Examples of the antioxidant include a phenol-based compound, a hydroquinone-based compound, a tocopherol-based compound, an amine-based compound, and the like. Among these examples, a hindered phenol derivative, a hindered amine derivative, and a mixture thereof are preferable.

Since the antioxidant or the ultraviolet absorber is contained in the single-layer photosensitive layer, the single-layer photosensitive layer can be prevented from being degraded by an oxidized gas such as nitroxide and the like, and can enhance stability of the coating solution for forming the single-layer photosensitive layer.

A content of the antioxidant in the single-layer photosensitive layer ranging from 0.1 parts by weight to 50 parts by weight inclusive based on 100 parts by weight of the charge transport material is desirable. In the case where the antioxidant content exceeds 50 parts by weight, a photoreceptor property of the single-layer photosensitive layer could be adversely affected. In the case where the antioxidant content falls below 0.1 parts by weight, sufficient effects of enhancing stability of the coating solution and durability of the single-layer photoreceptor could not be achieved.

Examples of the plasticizer include: a diacid ester such as a phthalate ester and the like; a fatty acid ester; an ester phosphate; a chlorinated paraffin; an epoxy-type plasticizer; and the like.

The leveling agent includes, for example, a silicon-based leveling agent and the like.

Since the plasticizer or the leveling agent is contained in the single-layer photosensitive layer, film formation, plasticity, and surface smoothness of the single-layer photosensitive layer can be enhanced.

A temperature maintained during the drying process for preparing the single-layer photosensitive layer is not particularly limited, as long as the temperature is proper to eliminate the organic solvent. However, a temperature ranging from 50° C. to 140° C. inclusive is preferable, and a temperature ranging from 80° C. to 130° C. inclusive is more preferable.

In the case where the drying temperature exceeds 140° C., an electric property of the single-layer photoreceptor could be degraded after the photoreceptor is repeated used, and an image could be degraded. In the case where the drying temperature falls below 50° C., drying time could be prolonged.

Such temperature conditions for preparing the single-layer photosensitive layer can be reflected not only in the preparation of the single-layer photosensitive layer, but also in preparations of other layers such as the inner layer, which will be described below, and a treatment(s) of the layers.

Although a thickness of the single-layer photosensitive layer is not particularly limited, a thickness ranging from 5 μm to 40 μm inclusive is preferable, and a thickness ranging from 10 μm to 30 μm inclusive is more preferable.

In the case where the thickness of the single-layer photosensitive layer exceeds 40 μm, productivity of the single-layer photoreceptor could decrease. In the case where the thickness of the single-layer photosensitive layer falls below 5 μm, electric retentivity of the single-layer photoreceptor surface could decrease, and a contrast of an outputted image could decrease.

Inner Layer 18

The single-layer photoreceptor of the present invention is desirable to comprise the inner layer 18 positioned between the conductive substrate 11 and the single-layer photosensitive layer 140.

The inner layer is capable of preventing the electrical charges from being injected from the conductive substrate to the single-layer photosensitive layer. Therefore, electrification of the single-layer photosensitive layer is inhibited from decreasing. Also, electrical charges in a partial surface of the single-layer photosensitive layer other than a partial surface thereof where electrical charges should be eliminated by exposure are inhibited from decreasing, and an image defect such as an image fogging is prevented from being generated. Particularly, in the case where an image is formed during a reversal development process, the image fogging called a black dot which is a minute black spot of a toner formed on a white background is prevented from being developed.

Further, the inner layer that covers the conductive substrate surface decreases the degree of irregularities of the conductive substrate surface which are a defect and thus uniformalizes the conductive substrate surface. Furthermore, the inner layer increases film formation of the single-layer photosensitive layer, and enhances adhesion between the conductive substrate and the single-layer photosensitive layer.

The inner layer is formed, for example, from a coating solution that is prepared by dissolving a resin material in a proper solvent, is applied to the conductive substrate surface, and is dried so as to eliminate an organic solvent contained therein.

Examples of the resin material include: the binder resin which is contained in the single-layer photosensitive layer; a natural polymer material such as a casein, a gelatin, a polyvinyl alcohol, an ethyl cellulose, and the like; and the like, and these examples can be used solely, or the two or more examples can be mixed. Among these examples, a polyamide resin is preferable, and an alcohol-soluble nylon resin is more preferable. Examples of the alcohol-soluble nylon resin include: a copolymer nylon resin that copolymerizes 6-nylon, 6,6-nylon, 6,10-nylon, 11-nylon, 2-nylon, 12-nylon, and the like; a nylon resin that is chemically denatured such as N-alkoxymethyl denatured nylon and N-alkoxyethyl denatured nylon; and the like.

Examples of the solvent that dissolves or disperses the resin material include: water; alcohol such as methanol, ethanol, butanol, and the like; grime such as methyl carbitol, butyl carbitol, and the like; chlorinated solvents such as dichloroethane, chloroform, trichloroethane, and the like; acetone; dioxolan; a mixed solvent that comprises the two or more solvents above; and the like. Among these examples, non-halogen-type organic solvents are preferably used out of respect for a global environment.

Other processes for preparing the inner layer and conditions therefor are the same as those for preparing the single-layer photosensitive layer.

Incidentally, the coating solution for preparing the inner layer may comprise metal oxide particles.

The metal oxide particles can easily control a volume resistance value of the inner layer, can further inhibit the electrical charges from being injected to the single-layer photosensitive layer or a laminated photosensitive layer, and can maintain an electric property of the photoreceptor in various environments.

Examples of the metal oxide particles include titanium oxide, aluminum oxide, aluminum hydroxide, tin oxide, and the like.

A ratio C/D between a total weight C of the binder resin and the metal oxide particles and a weight D of the solvent in the coating solution for preparing the inner layer ranging from 1/99 to 40/60 inclusive is desirable, but a ratio ranging from 2/98 to 30/70 inclusive is preferable.

A ratio E/F between a weight E of the binder resin and a weight F of the metal oxide particles ranging from 90/10 to 1/99 inclusive is desirable, but a ratio ranging from 70/30 to 5/95 inclusive is preferable.

A thickness of the inner layer is not particularly limited, but a thickness ranging from 0.01 μm to 20 μm inclusive is preferable, and a thickness ranging from 0.05 μm to 10 μm inclusive is more preferable.

In the case where the thickness of the inner layer exceeds 20 μm, it is difficult to form the inner layer uniformly and thus to form the single-layer photosensitive layer uniformly on the inner layer, and therefore sensitivity of the photoreceptor could decrease. In the case where the thickness of the inner layer falls below 0.01 μm, the inner layer is not capable of functioning substantially, and the inner layer that is to cover the irregularities of the conductive substrate surface could decrease uniformity. Therefore, the inner layer cannot prevent the electrical charges from being injected from the conductive substrate to the single-layer photosensitive layer, and the electrification of the single-layer photosensitive layer decreases.

In the case where a constituent material of the conductive substrate is aluminum, the inner layer may be an alumite layer that comprises alumite.

The image forming apparatus (which is also the electrophotographic device) of the present invention is provided with: the single-layer electrophotographic photoreceptor of the present invention; the charging means for charging the electrophotographic photoreceptor; the exposure means for exposing the charged single-layer electrophotographic photoreceptor to the laser beam with the wavelengths of from 400 nm to 450 nm; and the image development means for developing the electrical latent image which is formed by the exposure.

The electrophotographic device of the present invention and its functions will be described with reference to the drawings, but are not limited to the descriptions below.

FIG. 3 is the typical side view showing the structure of the electrophotographic device of the present invention.

An electrophotographic device 100 (i.e. laser printer) shown in FIG. 3 is provided with: the single-layer photoreceptor 1 (see FIG. 1); charging means 32 (i.e. corona electrostatic charger); exposure means 31 (i.e. semiconductor laser); image development means 33 (i.e. developing machine);

transfer means 34 (i.e. transfer charger); a conveyor belt (not shown); fixing means 35 (i.e. fixing machine); and cleaning means 36 (i.e. cleaner). The reference numeral 51 denotes transfer paper which is a recording medium.

The single-layer photoreceptor 1 is rotatably supported by an electrophotographic device 100 body (not shown), and rotates in a direction of an arrow 41 on a rotation axis 44 by use of driving means (not shown). The driving means is constituted of, for example, an electric motor and a decelerating gear, and conducts a driving force to the conductive substrate that constitutes a core body of the single layer photoreceptor 1, so that the driving means rotates the single-layer photoreceptor 1 at a predetermined peripheral velocity. The electrostatic charger 32, the exposure means 31, the developing machine 33, the transfer charger 34, and the cleaner 36 are positioned on the peripheral surface of the single-layer photoreceptor 1 in this order from upstream to downstream of the rotation direction of the single-layer photoreceptor 1 indicated by the arrow 41.

The electrostatic charger 32 is the charging means for uniformly charging the peripheral surface of the single-layer photoreceptor 1 at a predetermined potential.

The charging means used in the electrophotographic device of the present invention is desirable to be a positive electric type out of respect for a decrease of a hazardous ozone gas.

The exposure means 31 is provided with a blue light semiconductor laser as a light source, irradiates the peripheral surface of the single-layer photoreceptor 1 between the electrostatic charger 32 and the developing machine 33 with a laser beam outputted from the light source, and exposes the charged peripheral surface of the single-layer photoreceptor 1 to the laser beam in accordance with image information. The laser beam repeatedly scans the peripheral surface of the single-layer photoreceptor 1 in an extending direction of the rotation axis 44 of the single-layer photoreceptor 1 which is a main scanning direction, and the repeated scanning forms electrical latent images in series on the peripheral surface of the single-layer photoreceptor 1. Namely, a charging amount on the peripheral surface of the single-layer photoreceptor 1 that is uniformly charged by the electrostatic charger 32 changes in an irradiated region and an unirradiated region of the peripheral surface of the single layer photoreceptor 1, and an electrical latent image is formed by these differences.

The developing machine 33 is the image development means for developing with use of a developer (i.e. toner) the electrical latent image formed on the peripheral surface of the single-layer photoreceptor 1 by the exposure, is positioned adjacent to the peripheral surface of the single-layer photoreceptor 1, and is constituted of a developing roller 33*a* that supplies the toner to the peripheral surface of the single-layer photoreceptor 1 and a casing 33*b* that allows the developing roller 33*a* to rotate on a rotation axis which is parallel to the rotation axis 44 of the single-layer photoreceptor 1 and that stores the developer (such as the toner) therein.

The transfer charger 34 is the transfer means for transferring a toner image, which is formed on the peripheral surface of the single-layer photoreceptor 1 and is visible due to the image development, onto the transfer paper 51 which is supplied to a space between the single-layer photoreceptor 1 and the transfer charger 34 by conveying means (not shown) in a direction of an arrow 42. The transfer charger 34 is, for example, charging means and may be noncontact transfer means that supplies an electrical charge, which has a polarity opposite to that of the toner, to the transfer paper 51, so that a toner image is transferred onto the transfer paper 51.

The cleaner 36 is the cleaning means for cleaning and collecting a toner remained on the peripheral surface of the single layer photoreceptor 1 after the transfer of the toner image conducted by the transfer charger 34, and is constituted of a cleaning blade 36*a* that exfoliates the remaining toner on the peripheral surface of the single-layer photoreceptor 1 and a casing 36*b* that stores the toner therein exfoliated by the cleaning blade 36*a*. Incidentally, the cleaner 36 is provided with a static elimination lamp (not shown).

Further, the electrophotographic device 100 is provided with the fixing machine 35, which is the fixing means for fixing the transferred image, downstream of the conveyance direction of the transfer paper 51. The transfer paper 51 is conveyed to the fixing machine 35 after passing through the space between the single-layer photoreceptor 1 and the transfer charger 34. The fixing machine 35 is constituted of a heating roller 35*a* that is provided with heating means (not shown) and a pressure roller 35*b* that is positioned opposite to the heating roller 35*a* and has a contact portion where is in contact with and pressed by the heating roller 35*a*.

The reference numeral 37 denotes separation means that separates the transfer paper from the receptor, and the reference numeral 38 denotes a housing that stores the abovementioned various means.

An image formation by use of the electrophotographic device 100 is conducted as follows. Firstly, the driving means rotates the single-layer photoreceptor 1 in the direction of the arrow 41, and then the electrostatic charger 32, which is positioned upstream of the rotation direction of the single-layer photoreceptor 1 from an image formation point of the laser beam emitted from the exposure means 31, positively charges the peripheral surface of the single-layer photoreceptor 1 uniformly at the predetermined potential.

Secondly, the exposure means 31 irradiates the peripheral surface of the single-layer photoreceptor 1 with a laser beam in accordance with image information. Due to this exposure, electrical charges on a partial peripheral surface of the single-layer photoreceptor 1 where is irradiated with the laser beam are eliminated. Therefore, it results in differences between a potential on the partial peripheral surface where is irradiated with the laser beam and a potential on the other peripheral surface where is not irradiated with the laser beam, and thus an electrical latent image is formed on the peripheral surface of the single-layer photoreceptor 1.

Thirdly, the developing machine 33, which is positioned to downstream of the rotation direction of the single-layer photoreceptor 1 from the image formation point of the laser beam emitted from the exposure means 31, supplies a toner to the peripheral surface of the single-layer photoreceptor 1 on which the electrical latent image is formed, and develops the electrical latent image, so that a toner image is formed on the peripheral surface of the single-layer photoreceptor 1.

Lastly, transfer paper 51 is supplied to the space between the single-layer photoreceptor 1 and the transfer charger 34 simultaneously with the exposure of the single-layer photoreceptor 1 to the laser beam. The transfer paper 51 is supplied with an electrical charge, which has a polarity opposite to that of the toner, by the transfer charger 34, and then the toner image formed on the peripheral surface of the single-layer photoreceptor 1 is transferred onto the transfer paper 51.

The transfer paper 51 onto which the toner image is transferred is conveyed by the conveying means to the fixing machine 35, and is heated and pressed while passing through the contact portion between the heating roller 35*a* and the pressure roller 35*b* of the fixing machine 35. Then, the toner image is fixed to the transfer paper 51, and becomes a durable image. The transfer paper 51 on which the durable image is formed in this way is then ejected from the electrophotographic device 100 by the conveying means.

Meanwhile, the toner, which is remained on the peripheral surface of the single-layer photoreceptor 1 after the transfer of the toner image conducted by the transfer charger 34, is exfoliated from the peripheral surface by the cleaner 36, and is collected. Electrical charges on the peripheral surface of the single-layer photoreceptor 1 from which the toner is eliminated in this way are eliminated by light emitted from the static elimination lamp, and the electrical latent image formed on the peripheral surface of the single-layer photoreceptor 1 disappears. Then, the driving means rotates the single-layer photoreceptor 1 again, and the abovementioned sequence starts from the charging of the peripheral surface of the single-layer photoreceptor 1, so that images are formed successively.

EXAMPLES

The present invention will be described by means of Examples and Comparative Examples. However, the present invention is not limited to these Examples.

Example 1

9 parts by weight of titanium oxide (trade name: Tipaque TTO-D-1; manufactured by Ishihara Sangyo Kaisha, Ltd.) and 9 parts by weight of a copolyamide resin (trade name: Amilan CMS8000; manufactured by Toray Industries, Inc.) were added to a mixed solvent of 41 parts by weight of 1,3-dioxolan and 41 parts by weight of methanol, and a mixture was subjected to a dispersion treatment for 12 hours with use of a paint shaker in order to prepare 3 L of a coating solution for preparing an intermediate layer.

This coating solution was applied to a PET film, which is a conductive substrate and is vapor-deposited with aluminum, by an application method with use of an applicator in order to form an intermediate layer with a thickness of 1 μm.

8 parts by weight of Compound 2-6 and 14 parts by weight of tetrahydrofuran were subjected to the dispersion treatment for 5 hours with use of the paint shaker in order to prepare a dispersion liquid. Meanwhile, 120 parts by weight of Compound 1-1 and 144 parts by weight of a polycarbonate resin (trade name: PCZ-400; manufactured by Mitsubishi Gas Chemical Co., Inc.) as a binder resin were added and dissolved in 1056 parts by weight of tetrahydrofuran. This mixture was added to the above mentioned dispersion liquid, and a mixture was homogenized by a homogenizer in order to prepare 3 L of a coating solution for preparing a photosensitive layer.

This coating solution was applied to the inner layer by the application method with use of the applicator in order to prepare a film made of the coating solution. The film was dried by heated air at 110° C. for 60 minutes in order to prepare a single-layer photosensitive layer with a thickness of 20 μm, so that the electrophotographic photoreceptor shown in FIG. 2 can be prepared, which is formed from the single-layer photosensitive layer with the thickness of 20 μm.

Example 2

A single-layer photoreceptor was prepared in the same manner as Example 1 except that Compound 1-43 was used instead of Compound 1-1.

Example 3

A single-layer photoreceptor was prepared in the same manner as Example 1 except that Compound 1-111 was used instead of Compound 1-1.

Example 4

A single-layer photoreceptor was prepared in the same manner as Example 1 except that Compound 2-7 was used instead of Compound 2-6.

Example 5

A single-layer photoreceptor was prepared in the same manner as Example 2 except that Compound 2-7 was used instead of Compound 2-6.

Example 6

A single-layer photoreceptor was prepared in the same manner as Example 3 except that Compound 2-7 was used instead of Compound 2-6.

Example 7

A single-layer photoreceptor was prepared in the same manner as Example 1 except that Compound 2-2 was used instead of Compound 2-6.

Comparative Example 1

A single-layer photoreceptor was prepared in the same manner as Example 1 except that Compound 2-6 was not used, and the dispersion liquid was not prepared.

Comparative Example 2

The single-layer photoreceptor shown in FIG. 2 was prepared in the same manner as Comparative Example 1 except that a triphenyamine-based compound (TPD) (trade name: D2448; manufactured by Tokyo Chemical Industry Co., Ltd.) having the following structure was used instead of Compound 1-1:

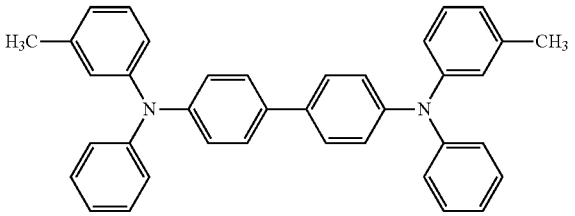

Comparative Example 3

An intermediate layer was prepared in the same manner as Example 1.

1 part by weight of a butyral resin (trade mark: S-Lec BM-2; manufactured by Sekisui Chemical Co., Ltd.), 97 parts by weight of methylethyl ketone, and 2 parts by weight of titanyl phthalocyanine (prepared by a known method disclosed in Japanese Patent No. 3569422) represented by the following structure:

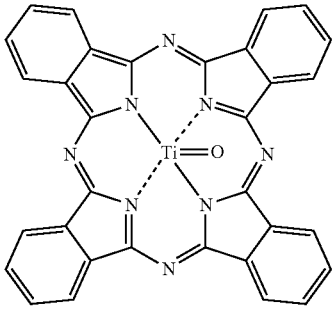

were dispersed for 72 hours by a ball mill in order to prepare 3 L of a coating solution for preparing a charge generation layer.

This coating solution was used for preparing on the conductive substrate provided with the inner layer a charge generation layer with a thickness of 0.2 μm by the application method with use of the applicator.

120 parts by weight of the above-mentioned triphenyamine-based compound (TPD) and 144 parts by weight of a polycarbonate resin (trade name: PCZ-400; manufactured by Mitsubishi Gas Chemical Co., Inc.) as a binder resin were added and dissolved in 1056 parts by weight of tetrahydrofuran in order to prepare 3 L of a coating solution for preparing a charge transport layer.

This coating solution for preparing the charge transport layer was applied to the charge generation layer by the application method with use of the applicator in order to prepare a film made of the coating solution. The film was dried by heated air at 120° C. for 60 minutes in order to prepare a laminated photosensitive layer with a thickness of 20 μm, so that a laminated electrophotographic photoreceptor formed from the laminated photosensitive layer can be prepared.

Comparative Example 4

An intermediate layer was prepared in the same manner as Example 1. Then, a charge transport layer and a charge generation layer were laminated in this order which is a reverse order of Comparative Example 3, so that a laminated electrophotographic photoreceptor formed from the reverse-laminated photosensitive layer can be prepared.

Evaluations

1. Evaluation of Electric Potential

An electric property of the electrophotographic photoreceptors of Examples 1 to 7 and Comparative Examples 1 to 4 each was evaluated as follows with use of an electrostatic paper analyzer (trade name: EPA-8200; manufactured by Kawaguchi Electric Works Co., Ltd.).

A peripheral surface of each photoreceptor was positively charged so that an electric potential thereof will be 600 V, and was exposed to light with a wavelength of 400 nm, in which xenon lamplight with 300 W was spectrally distributed by an interference filter, and with strength of 5 $\mu W/cm^2$ adjusted by an ND filter, and then light exposure of each photoreceptor surface was measured as half-reduced light exposure E 1/2 [$\mu J/cm^2$] in which the surface potential of the photoreceptor was reduced to 300 V.

2. Evaluation of Images

A portion for grounding was attached to a photoreceptor drum of the photoreceptors of Examples 1 to 7 and Comparative Examples 1 to 4 each. Then, a negative electric-type digital copy machine (trade name: AR-266FP; manufactured by Sharp Corporation) with resolution of 1200 dpi provided with the above-mentioned photoreceptor was remodeled into a positive electric type, and an exposure unit (LSU) of the copy machine was remodeled into a blue light semiconductor laser with a wavelength of 405 nm. Resolution of images formed by the copy machine was then evaluated.

The images evaluated in a self-printing mode include a 1-line image, a 2-line image formed from vertical and horizontal lines, a 1-line-eliminated image on a black background, and a 1-by-1-dot image (in which dots are printed on every other dot).

Evaluation results will be indicated in Table 3 below.

TABLE 3

| | charge generation and charge transportation substances | electron-transport material | evaluation of electric potential E½ ($\mu J/cm^2$) | evaluation of image |
|---|---|---|---|---|
| Example 1 | Compound 1-1 | Compound 2-6 | 1.45 | Good |
| Example 2 | Compound 1-43 | Compound 2-6 | 1.21 | Good |
| Example 3 | Compound 1-111 | Compound 2-6 | 2.31 | Good |
| Example 4 | Compound 1-1 | Compound 2-7 | 1.25 | Good |
| Example 5 | Compound 1-43 | Compound 2-7 | 1.13 | Good |
| Example 6 | Compound 1-111 | Compound 2-7 | 2.11 | Good |
| Example 7 | Compound 1-1 | Compound 2-2 | 2.45 | Good |
| Comparative Example 1 | Compound 1-1 | — | 7.11 | Good |
| Comparative Example 2 | TPD | — | no sensitivity | N/A |
| Comparative Example 3 | TiOPc/TPD (laminated) | — | no sensitivity | N/A |
| Comparative Example 4 | TPD/TiOPc] (reverse laminated) | — | 0.23 | unclear |

It was found from the evaluation results that the photoreceptors of Examples 1 to 7 that each comprises the enamine-type compound as both the charge generation material and the charge transport material and the perylene-type compound as both the electron-transport material and the sensitizer were superior to the photoreceptors of Comparative Examples in electric potential and image.

Namely, it was found from Comparative Example 1 that the enamine-type compound of the present invention functioned as both the charge generation material and the charge transport material, and it was also found from Examples 1 to 7 that the perylene-type compound of the present invention enhanced sensitivity of the photoreceptor. Furthermore, it was found that an image forming apparatus could be realized, which adequately capitalizes on a merit of an optical system acquired from the shortened wavelength of the laser beam emitted from the light source despite the heightened resolution.

Moreover, it was found that the photoreceptor of Comparative Example 2 did not have luminosity sensitivity.

Figure 5:
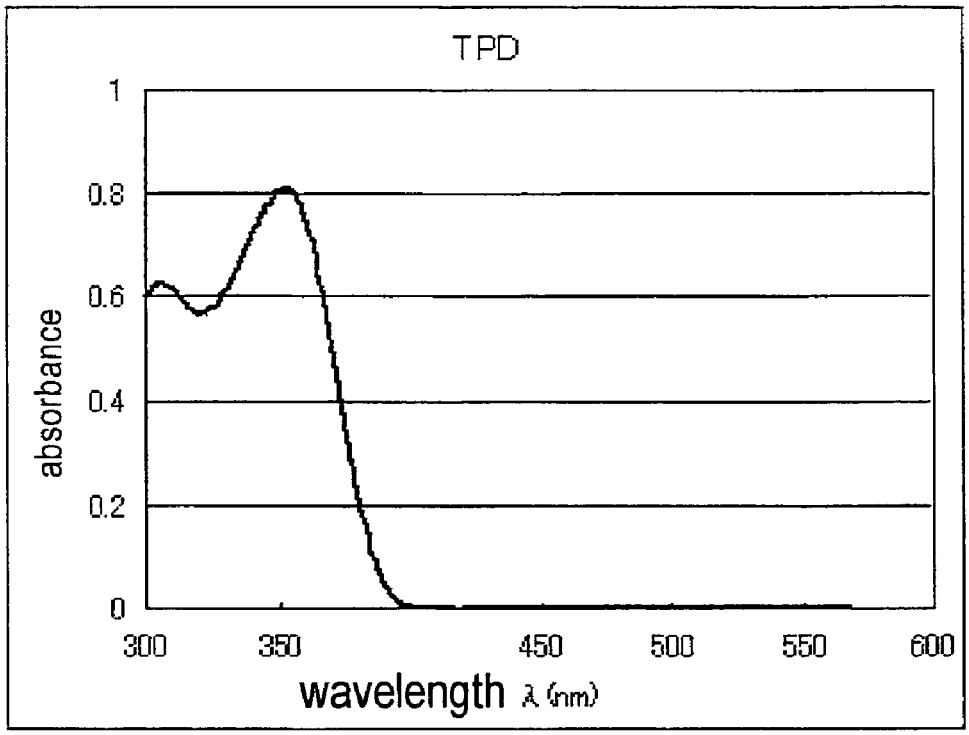
FIG. 5 shows absorption spectra of a triphenylamine-based compound used in Comparative Examples (in which a triphenylamine-based compound concentration is the same as that of the enamine-type compound as described above).

This is believed based on facts indicated in absorption spectra shown in FIG. 5 that the triphenyamine-based compound (TPD) used in the photosensitive layer did not have an absorption band within a range of wavelengths of from 400 nm to 450 nm, and thus electrical charges were not generated.

Further, it was found that the photoreceptor of Comparative Example 3 did not have luminosity sensitivity.

This experiment was conducted with use of the conventional laminated photoreceptor. The triphenyamine-based compound of Comparative Example 3 does not absorb light within the above-mentioned range as described above, and thus passes the light therethrough, and the light is absorbed by oxytitanium phthalocyanine which is the organic pigment. A reason why the photoreceptor of Comparative Example 3 did not have the luminosity sensitivity is believed based on facts that the triphenyamine-based compound did not function as an electron-transport material even though electrical charges are generated on the photoreceptor surface, and cannot eliminate the electrical charges therefrom.

It was found that the photoreceptor of Comparative Example 4 had high sensitivity.

However, after repeatedly used for the evaluation of the images, the photoreceptor got more line-like scratches on its peripheral surface, and the image evaluation could not be continued.

Oxytitanium phthalocyanine has a wide absorption band in a near-infrared area, and is extensively used for a laser printer. In the meanwhile, it also has a narrow absorption band in a short-wavelength area of a wavelength of around 400 nm, and electrical charges are generated. It is believed that a negative charge generated by the charge generation layer in the vicinity of the photoreceptor surface eliminated electrical charges, and a positive charge transferred to the charge transport layer comprising the triphenyamine-based compound, passed through the inner layer, and reached to the substrate.

Accordingly, although the photoreceptor of Comparative Example 4 does not have any problem with the electric property, it easily gets the scratches due to weak film strength and a high content ratio of the organic pigment in the charge generation layer at the photoreceptor surface, and thus has a critical problem with wear resistance.

The present invention can provide the electrophotographic device and the single-layer photoreceptor provided thereto that is suitable for being exposed by the blue light semiconductor laser, has the high sensitivity and resolution, and is stable, since the single-layer photoreceptor comprises: the enamine-type compound which is represented by the above-mentioned general formula (1) and functions as both the charge generation material and the charge transport material; and the perylene-type compound which is represented by the above-mentioned general formula (2) and functions as both the electron-transport material and the sensitizer. The present invention also can provide the positive electric-type single-layer photoreceptor that generates less ozone.

What is claimed is:

1. A single-layer electrophotographic photoreceptor provided with a single-layer photosensitive layer that adapts to an exposing source emitting a laser beam with wavelengths of from 400 nm to 450 nm inclusive and is laminated on a conductive substrate, the single-layer photosensitive layer comprising:

an enamine-type compound that functions as both a charge generation material and a charge transport material and is represented by the general formula (1):

(1)

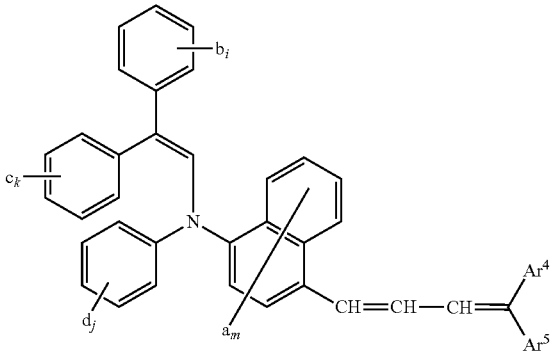

wherein a represents a hydrogen atom, a halogen atom or an alkyl group, alkoxy group, dialkylamino group or aryl group, which may have a substituent(s);

m represents an integer of 1 to 6, and when m is 1, a represents a hydrogen atom, a halogen atom or an alkyl group, alkoxy group, dialkylamino group or aryl group, which may have a substituent(s);

when m represents the integer of 2 or more, a is two or more and each represents a hydrogen atom, a halogen atom or an alkyl group, alkoxy group, dialkylamino group or aryl group, which may have a substituent(s) and may be the same or different, and when a represents 2 or more adjacent alkyl groups, the 2 or more adjacent alkyl groups may bind to each other and form a ring structure;

b, c and d may be the same or different, and each represent a hydrogen atom, a halogen atom or an alkyl group, alkoxy group, dialkylamino group, aryl group, aryloxy group or arylthio group, which may have a substituent(s);

i j and k may be the same or different, and each represent an integer of 1 to 5, and when i, j or k represents the integer of 2 or more, b, c or d is 2 or more and each may be the same or different, and b, c or d which binds to adjacent carbon atoms of a benzene ring may bind to each other and form a ring structure; and $Ar^4$ and $Ar^5$ may be the same or different, and each represent a hydrogen atom or an alkyl group, aryl group, aralkyl group or heterocyclic group, which may have a substituent(s), but may not simultaneously be hydrogen atoms, and may bind to each other by means of an atom or an atom group and form a ring structure; and a perylene-type compound that functions as both an electron-transport material and a sensitizer and is represented by the general formula (2):

(2)

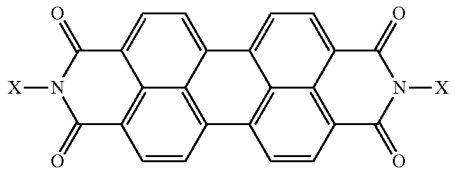

wherein X represents a hydrogen atom or an alkyl group, alkoxy group or aryl group which may be substituted.

2. The single-layer electrophotographic photoreceptor according to claim 1 wherein the general formula (1) has the following partial structure:

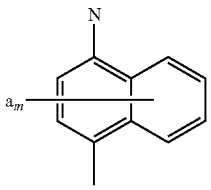

which may be as follows:
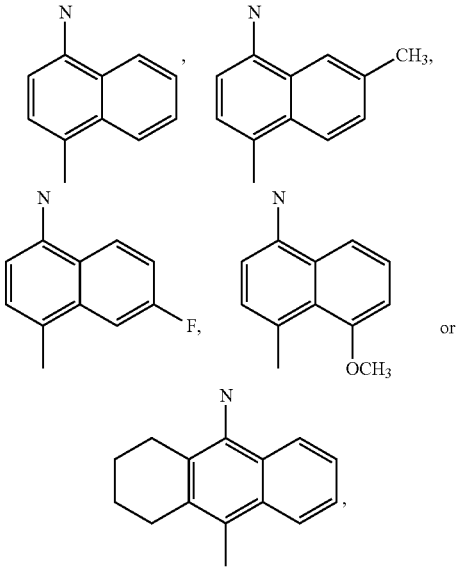
also has the following partial structures:
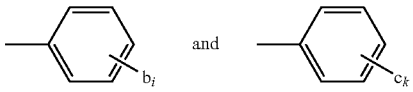
which are independent from each other and each may be as follows:
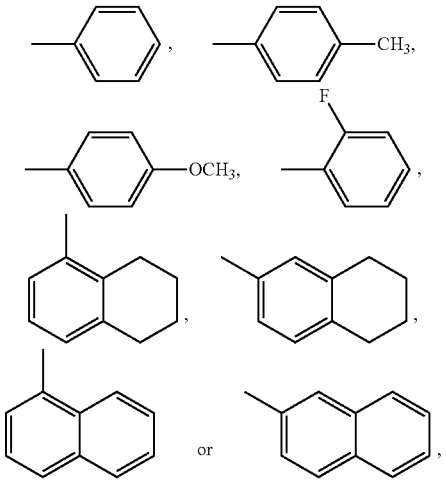
and further has the following partial structure:
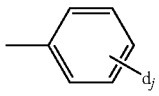
which may be as follows:
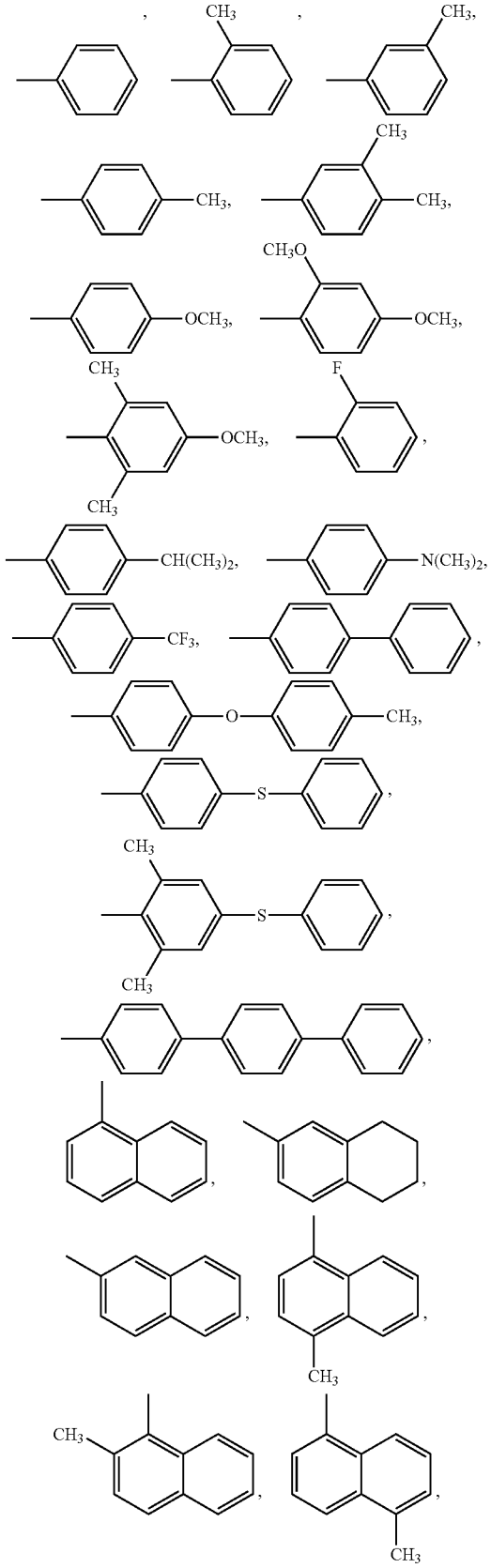

-continued
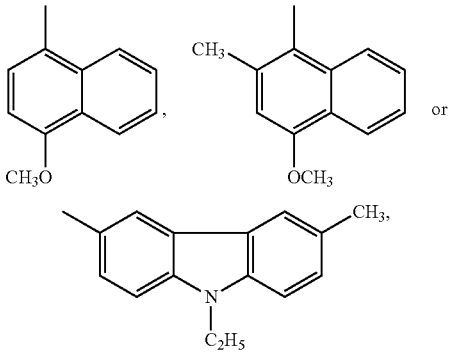
in which $Ar^4$ or $Ar^5$ in the general formula (1) may be the following substituents:
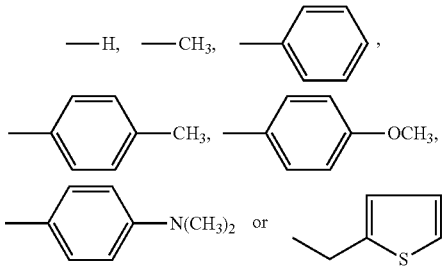
$Ar^5$ or $Ar^4$ also includes the following substituents:
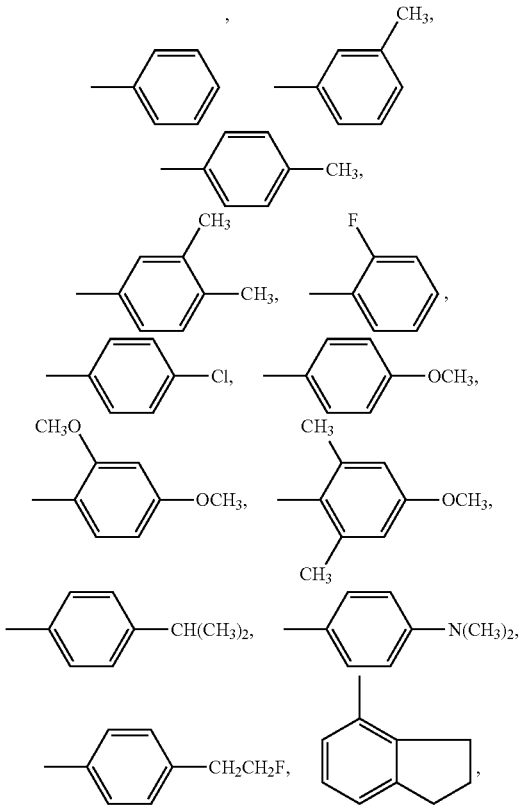
-continued
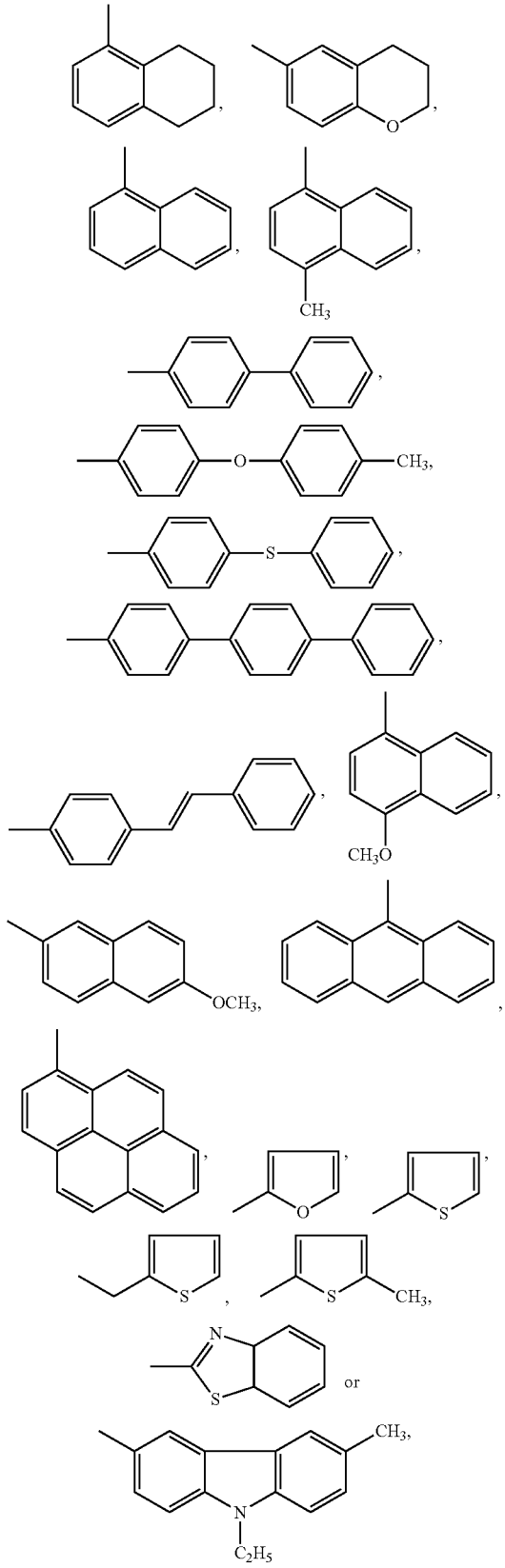
or $Ar^4$ and $Ar^5$ bind to each other and form the following substituents:

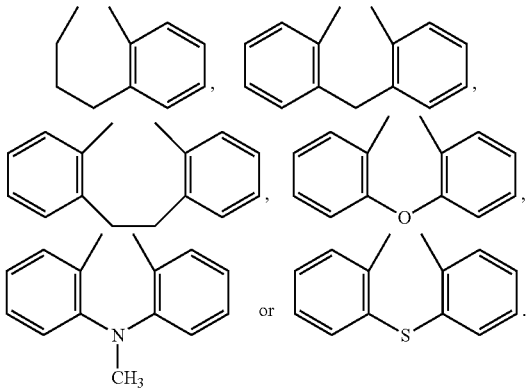

3. The single-layer electrophotographic photoreceptor according to claim 1 comprising the perylene-type compound represented by the general formula (2) that is selected from the group comprising compounds represented by the following formulas (3) to (5):

(3)

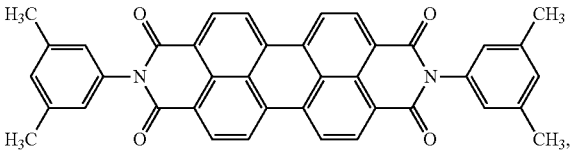

(4)

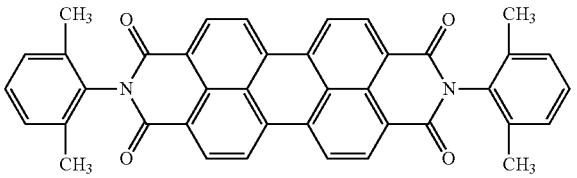

-continued and (5)

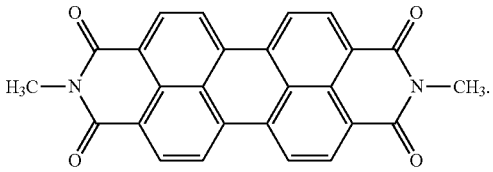

4. The single-layer electrophotographic photoreceptor according to claim 1 provided with an intermediate layer that is positioned between the conductive substrate and the single-layer photosensitive layer.

5. An image forming apparatus provided with: the single-layer electrophotographic photoreceptor according to claim 1;

charging means that charges the single-layer electrophotographic photoreceptor; exposure means that exposes the charged single-layer electrophotographic photoreceptor to a laser beam with exposure wavelengths of from 400 nm to 450 nm inclusive; and image development means that develops an electrical latent image formed by the exposure.

6. The image forming apparatus according to claim 5 wherein the exposure means is a blue light semiconductor laser.

7. The image forming apparatus according to claim 5 wherein the exposure means is a blue light semiconductor laser, and comprises a gallium nitride-based material.

8. The image forming apparatus according to claim 5 wherein the charging means is a positive electric type.

* * * * *